US006767316B2

(12) United States Patent
McQuary et al.

(10) Patent No.: US 6,767,316 B2
(45) Date of Patent: Jul. 27, 2004

(54) PACKAGING CONTAINER LINER INSERTION AND CUFFING APPARATUS AND METHODS

(75) Inventors: Richard McQuary, Spokane, WA (US); Gordon Langlot, Spokane, WA (US)

(73) Assignee: R. A. Pearson Co., Spokane, WA (US)

( * ) Notice: Subject to any disclaimer, the term of this patent is extended or adjusted under 35 U.S.C. 154(b) by 0 days.

(21) Appl. No.: 10/024,707

(22) Filed: Dec. 17, 2001

(65) Prior Publication Data

US 2003/0114286 A1 Jun. 19, 2003

(51) Int. Cl.[7] ..... B31B 07/00
(52) U.S. Cl. ..... 493/93; 493/95; 493/100
(58) Field of Search ..... 493/93, 95, 100, 493/101, 907; 53/175, 384.1, 386.1

(56) References Cited

U.S. PATENT DOCUMENTS

| | | | | |
|---|---|---|---|---|
| 3,606,821 A | | 9/1971 | Tsien | |
| 3,796,140 A | | 3/1974 | Adams et al. | |
| 4,035,988 A | | 7/1977 | Daniels | 53/183 |
| 4,083,293 A | | 4/1978 | Goldstein | 93/36.01 |
| 4,142,453 A | | 3/1979 | Gidewall et al. | 93/36.01 |
| 4,280,313 A | | 7/1981 | Akkala et al. | 53/175 |
| 4,489,537 A | * | 12/1984 | Gordon et al. | 53/511 |
| 4,522,012 A | | 6/1985 | Nelson | 53/175 |
| 4,676,284 A | | 6/1987 | DeCrane | 141/114 |
| 4,684,359 A | | 8/1987 | Herrington | 493/211 |
| 4,687,462 A | | 8/1987 | Rewitzer | 493/100 |
| 4,729,209 A | | 3/1988 | Owensby et al. | 53/434 |
| 4,829,741 A | | 5/1989 | Langen | 53/122 |
| 4,840,016 A | | 6/1989 | Muller, Jr. | 53/459 |
| 4,912,913 A | | 4/1990 | Rundle | 53/583 |
| 4,918,906 A | | 4/1990 | Ako | 53/449 |
| 5,100,370 A | | 3/1992 | Barbour | 493/100 |
| 5,140,801 A | | 8/1992 | Wild | 53/459 |
| 5,279,537 A | | 1/1994 | Lile | 493/100 |
| 5,507,132 A | | 4/1996 | Gwiazdon et al. | 53/469 |
| 5,735,786 A | * | 4/1998 | Krueger et al. | 493/101 |
| 5,916,078 A | * | 6/1999 | Herrin | 493/93 |
| 5,928,123 A | | 7/1999 | Davis, Jr. | 493/316 |
| 6,066,080 A | | 5/2000 | Benoit et al. | 493/95 |
| 6,132,350 A | | 10/2000 | Krueger et al. | 493/101 |
| 6,338,371 B1 | | 1/2002 | Araki et al. | 141/145 |
| 6,374,579 B1 | * | 4/2002 | Muller | 53/449 |
| 6,446,365 B1 | | 9/2002 | Sullivan et al. | 371/195 |

FOREIGN PATENT DOCUMENTS

FR 1242225 12/1959

OTHER PUBLICATIONS

1999 Brochure by R. A. Pearson Co., "Model Y1928, Bag Inserter", 2 pages.

* cited by examiner

*Primary Examiner*—Eugene Kim
(74) *Attorney, Agent, or Firm*—Wells St. John P.S.

(57) ABSTRACT

Methods and apparatuses for inserting flexible bags into open containers, and cuffing an open end of the flexible bags about a top edge of the open containers. The method and apparatus include a vacuum assembly having at least one movable vacuum head for engaging and positioning the flexible bags in preparation for their insertion into the open containers. An insertion assembly having a mandrel inserts the flexible bags into the open containers. A cuffing assembly can be included for cuffing the open end of the flexible bags over the top edges of the open containers. The vacuum assembly may engage a flexible bag from a bag dispenser while the mandrel is in an extended position within the container. The method and apparatus also facilitate the use of a vacuum assembly, insertion assembly, and cuffing assembly which are independently driven to provide greater speed and flexibility to the bag opening, insertion and cuffing processes.

56 Claims, 15 Drawing Sheets

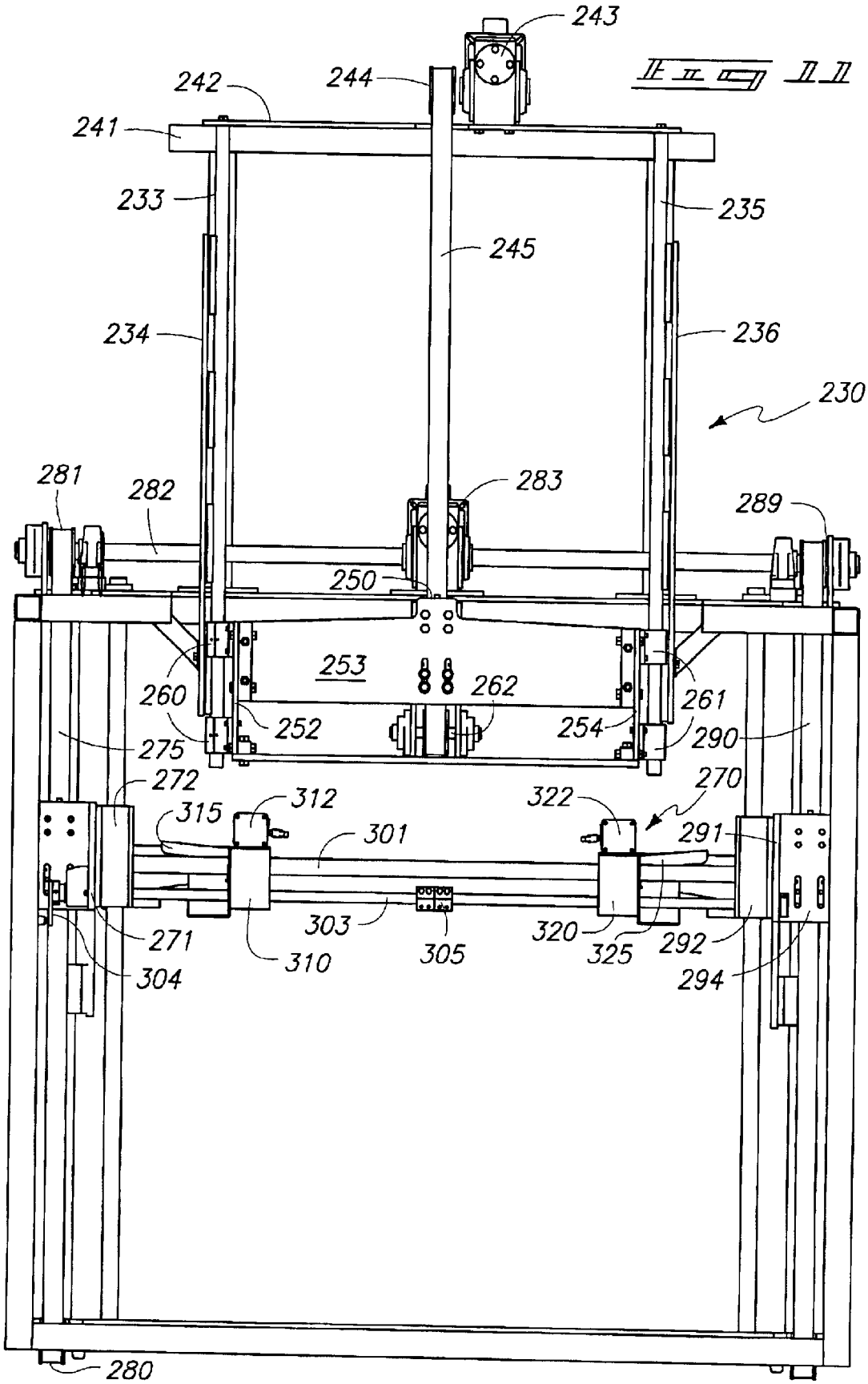
243
242
244
241
233
235
245
234
236
230
281
282
283
289
250
253
260
262
261
252
254
290
275
272
270
315
312
322
301
291
271
303
320
292
304
310
305
325
294
280

PACKAGING CONTAINER LINER INSERTION AND CUFFING APPARATUS AND METHODS

TECHNICAL FIELD

This disclosure pertains to machinery and methods for placing flexible bags and liners into packaging containers. It also pertains to cuffing the flexible bags and liners over an edge of the containers, such as cuffing plastic liner bags over the top edges of a cardboard box.

BACKGROUND OF THE INVENTION

This invention arose from the need to more efficiently automate the insertion of flexible liner bags into packaging containers. It is also common to cuff the bags about a top edge of the containers during instertion. Both of these are preferably accomplished at high production rates.

Containers or cartons lined with flexible bags are widely used for packaging a variety of products including food products, electronics and many others. Numerous devices have been developed in an effort to effectively automate these processes. However, these devices continue to have various shortcomings and there remains a need for methods and apparatuses which will more quickly insert and preferably cuff flexible bags into cardboard cartons or other packaging containers.

SUMMARY OF DISCLOSURE

The described embodiments of the present invention allows bag opening, insertion and cuffing processes to be accomplished independently for more effective and efficient operation. It uses at least one movable vacuum head to engage a flexible bag supplied by a bag dispenser. The vacuum heads engage the bag and then build sufficient vacuum. After vacuum is established, the moveable heads are parted to open and position the bag.

In the preferred apparatus, the vacuum head preferably engages the bag while an inserting mandrel or other insertion assembly is still in an extended position within the container which was previously lined. This allows vacuum to be established during a longer period of time, such as while cuffing and mandrel return operations are accomplished.

Engagement of the flexible bag by the vacuum heads allows vacuum to be developed earlier, so that the flexible bag may be moved into position for insertion into a container as soon as the insertion assembly is retracted. Prior devices returned the mandrel then brought the vacuum heads into contact with the liner bag. Developing vacuum thus delayed the operation.

The best mode of the invention uses a vacuum assembly, insertion assembly, and cuffing assembly to prepare, open, position and install a bag into a container, and to cuff the bag over the top edge of the container. These and other desirable aspects of the invention are described herein.

BRIEF DESCRIPTION OF THE DRAWINGS

Preferred embodiments of the invention are described below with reference to the following accompanying drawings.

FIG. 7 is a side elevational view showing portions of the vacuum assembly utilized in the packaging liner insertion apparatus of FIG. 1.

FIG. 10 is a side elevational view of portions of the packaging liner insertion apparatus of FIG. 1, also emphasizing the cuffing and the insertion assemblies.

FIG. 14A is a diagram representing various operational stages used in one process according to the inventions.

FIG. 14B is a diagram representing various operational stages used in one process according to the inventions.

DETAILED EXPLANATION OF THE INVENTION

The Framework of the Bag Insertion Apparatus

Figure 1:
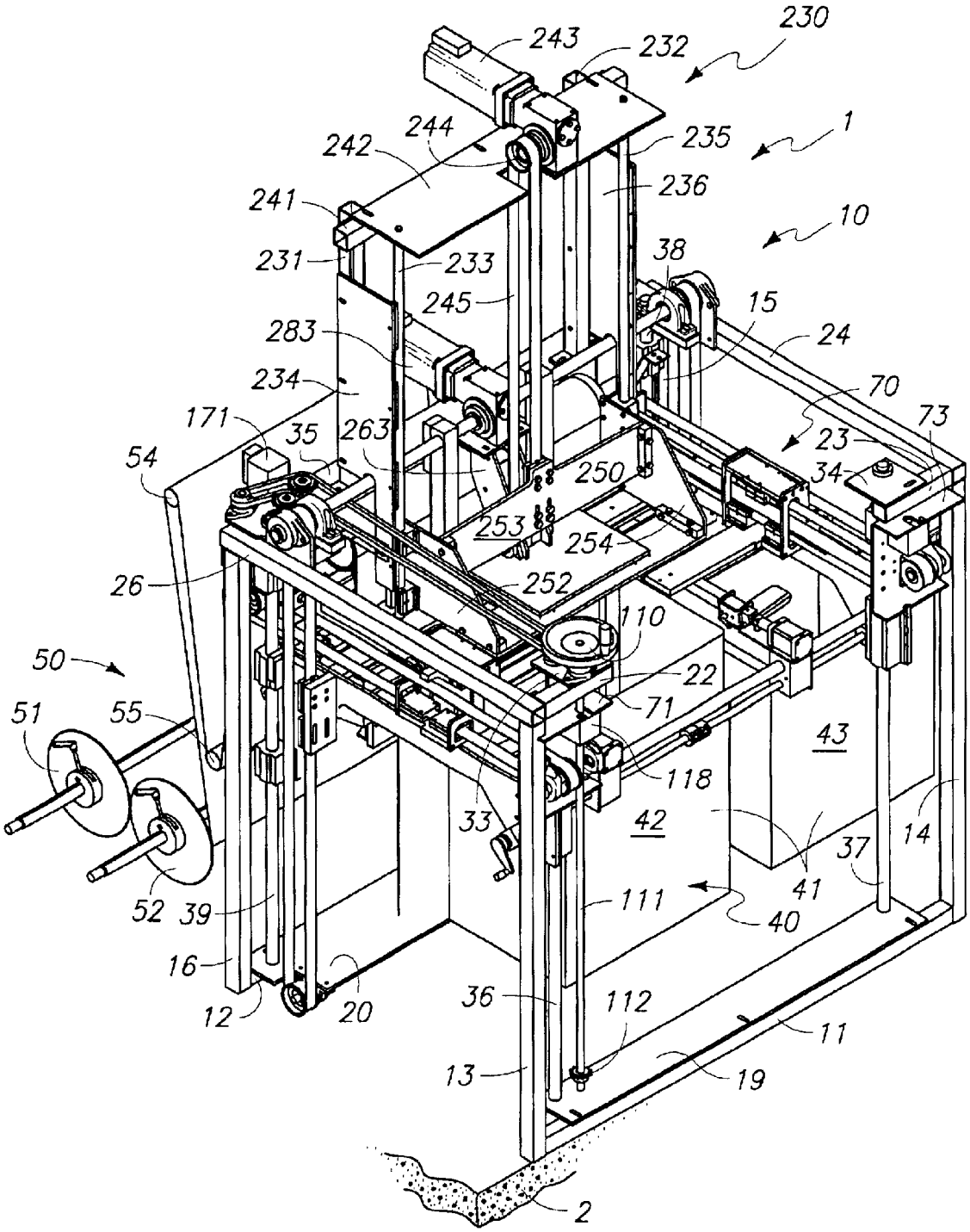
FIG. 1 is a perspective view showing portions of a preferred packaging liner insertion apparatus according to the invention.
Figure 2:
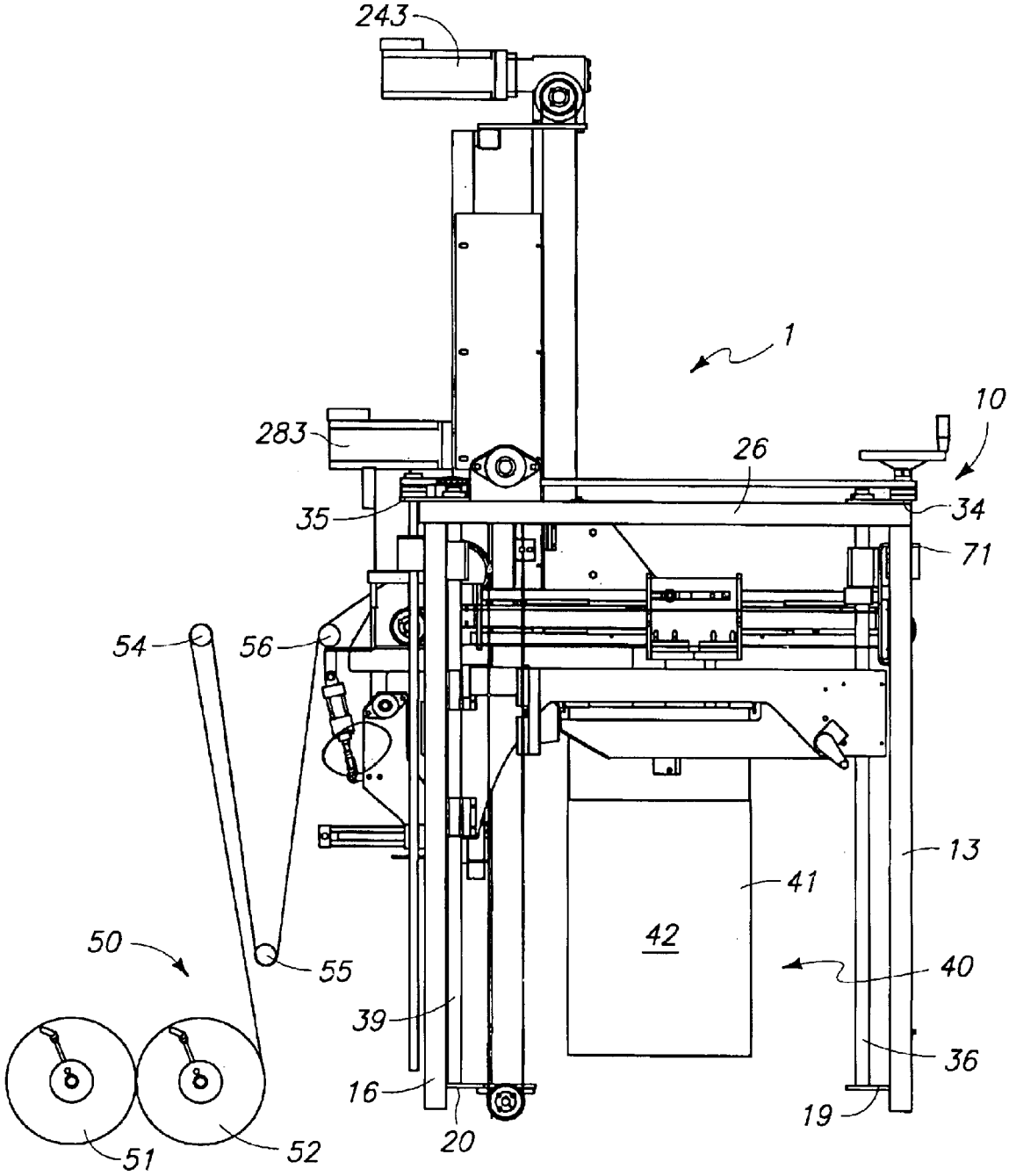
FIG. 2 is a side elevational view of the packaging liner insertion apparatus of FIG. 1.

FIGS. 1 and 2 show a preferred apparatus according to the present invention, which is generally indicated by the reference numeral 1. The apparatus 1 of the present invention has a main framework 10 which rests on a supporting surface 2 as described below.

As shown in FIG. 1, the main framework 10 includes four substantially upright or vertical rigid frame members 13, 14, 15 and 16. Four frame foot plates (not shown) are respectively securely affixed to the lower end of each of the four substantially upright or vertical rigid frame members 13, 14, 15 and 16. These frame foot plates rest on the supporting surface 2, and may be securely attached to the supporting surface 2 using a variety of fasteners or other suitable techniques.

Referring to FIG. 1, the main framework 10 also includes a first lower horizontal frame member 11 which is located near the front of the apparatus 1, and a second lower horizontal frame member 12 which is located near the back of the apparatus. The first and second vertical frame members 13 and 14 extend upwardly from near the ends of the first lower horizontal frame member 11, and are rigidly secured to the ends of the first lower horizontal frame member 11. Similarly, the third and fourth vertical frame members 15 and 16 extend upwardly from near the ends of the second lower horizontal frame member 12, and are similarly rigidly secured to the ends of the second lower horizontal frame member 12.

Referring to FIG. 1, a lower front frame mounting plate 19 is securely attached to the first lower horizontal frame member 11, while a lower rear frame mounting plate 20 is similarly attached to the second lower horizontal frame member 12. Each of these frame mounting plates 19 and 20 serve as a platform or base which may be used to support other components of the apparatus 1 as described below.

Referring again to FIG. 1, the four substantially upright or vertical rigid frame members 13, 14, 15 and 16 of main framework 10 extend upwardly where the upper ends of these frame members are connected to various structures as described below. A first upper frame horizontal member left segment 22 is securely attached near the upper end of the first vertical frame member 13. Similarly, a first upper frame horizontal member right segment 23 is securely attached near the upper end of the second vertical frame member 14.

In FIG. 1, the first upper frame horizontal member left and right segments 22 and 23 are shown extending horizontally cantilevered from the upper ends of the first and second vertical frame members 13 and 14. These members are cantilevered from each side in order to facilitate access to the apparatus 1.

Figure 3:
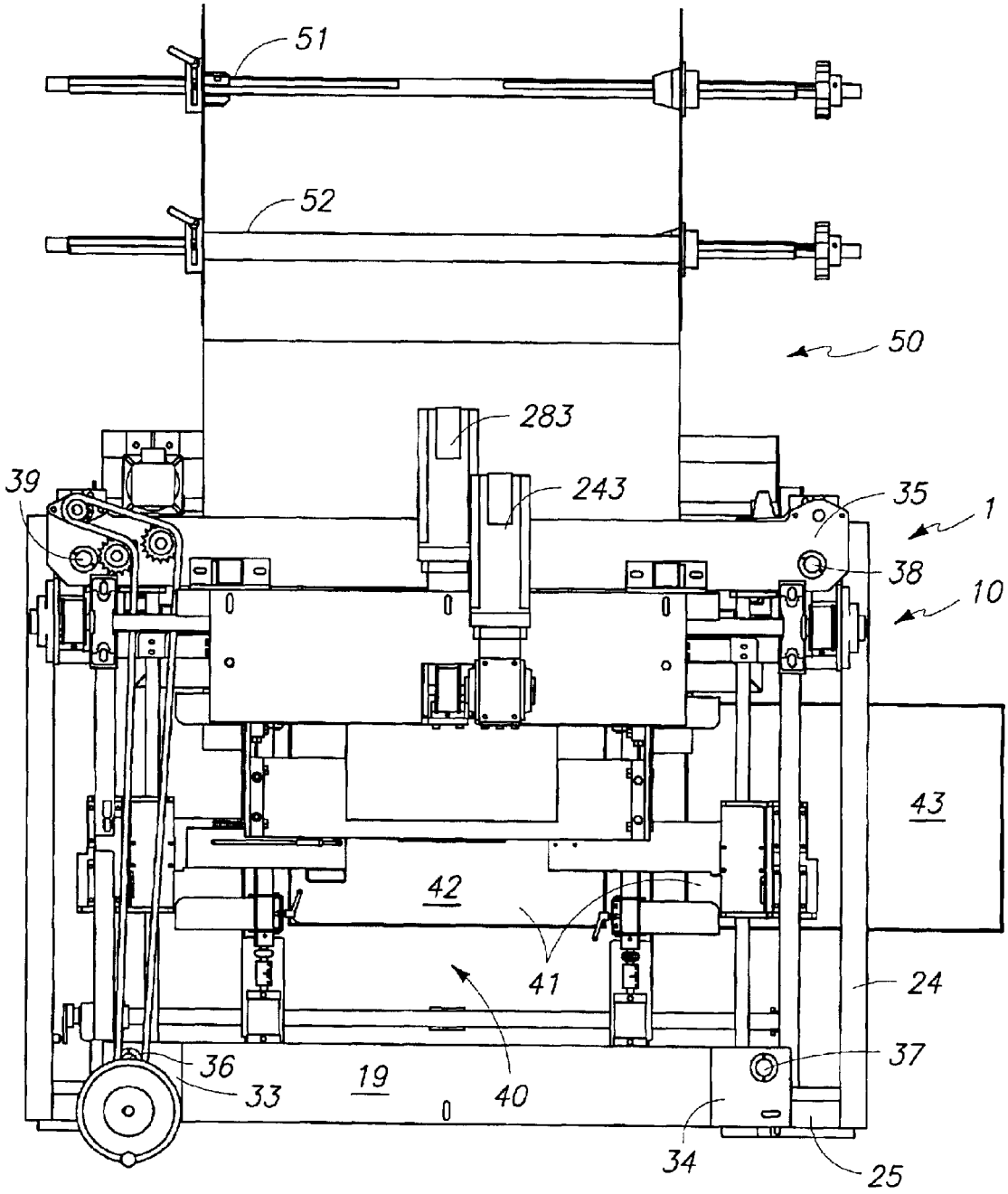
FIG. 3 is a top view of the packaging liner insertion apparatus of FIG. 1.

Referring now to FIGS. 1 and 3, a second upper frame horizontal member 24 spans the distance between the second and third vertical frame members 14 and 15, and is securely fixed to the upper ends thereof. Similarly, a third upper frame horizontal member (not illustrated) extends between the upper ends of the third and fourth vertical frame members 15 and 16, and is securely fixed to the upper ends thereof. Finally, a fourth upper frame horizontal member 26 extends between the upper ends of the first and fourth vertical frame members 13 and 16, being similarly securely fixed to the upper ends thereof.

As best seen in FIGS. 1 and 3, an upper front frame mounting plate left segment 33 is securely attached to the upper surface of the first upper frame horizontal member left segment 22. Similarly, an upper front frame mounting plate right segment 34 is securely attached to the upper surface of the first upper frame horizontal member right segment 23.

Still referring to FIGS. 1 and 3, an upper rear frame mounting plate 35 is also shown. The upper rear mounting plate 35 is securely attached to the upper surface of the third upper frame horizontal member (not shown). The upper rear frame mounting plate 35 is best seen in FIG. 3. Each of these upper frame mounting plates 33, 34 and 35 provide a stable mounting surface to which other components may be secured as described below.

Referring now to FIGS. 1 and 2, first frame guide rod 36 is shown to extend vertically between the lower front mounting plate 19 and the upper front mounting plate left segment 33. Similarly, the second frame guide rod 37 is shown to extend vertically between the lower front mounting plate 19 and the upper front mounting plate right segment 34. The third and fourth frame guide rods 38 and 39 extend vertically between the lower rear frame mounting plate 22 and the upper rear frame mounting plate 35. The ends of each of the four frame guide rods being securely attached to the respective mounting plates. These four frame guide rods 36, 37, 38 and 39 provide a slide frame which acts as a means for slidably mounting various components of the apparatus 1 which will be described in greater detail below.

Main framework 10 as described above advantageously defines a space which encompasses the container receiving area for receiving cartons, drums, pails, or other containers which are being positioned adjacent to or within insertion apparatus 1. A more detailed description of the container receiving area follows.

The Container Receiving Area

As best seen in FIGS. 1–4, the first, second, third and fourth vertical frame members 13, 14, 15 and 16 approximately define the four outer edges or corners of a tunnel shaped container or carton receiving area, which is generally indicated by the numeral 40 (FIG. 2). As shown in FIGS. 1–4, packaging cartons or other containers 41 are supplied to the container receiving area 40. A first packaging container 42 is shown positioned in the container receiving area 40, while a second packaging container 43 is waiting to be moved to the container receiving area 40. This second packaging container 43 will be moved into the container receiving area after the apparatus 1 has completed its insertion of a flexible bag into the first packaging container 42. The open end of the flexible bag is also preferably cuffed over the top edges of the first container 42 before second container 43 is moved into position for insertion of a liner bag.

Additional packaging containers (not shown) will be sequentially moved into the container receiving area 40 one container at a time, as the liner insertion and cuffing process proceeds. In the preferred embodiment, a powered conveyor belt (not shown) or other means of delivering or moving containers, will be utilized to deliver the containers 41 to the container receiving area 40. Such a conveyor may also be utilized to remove the containers 41 from the container receiving area 40 after the liner bags have been installed.

In the preferred embodiment, the main framework 10 is designed to fit over a powered carton or container conveyor which sequentially delivers the packaging containers 41 to the container receiving area 40. As each container arrives at the container receiving area 40, the apparatus of the present invention 1 will insert a flexible liner bag into the container and may cuff the open end of the flexible bag over the top edges of the open container if cuffing is desired. In the preferred embodiment, the flexible bags which are to be inserted into the containers 41 are dispensed to the container receiving area 40 by a bag dispenser which will be described in greater detail hereinafter.

The Bag Dispenser

Now referring to FIGS. 1, 2 and 3, the bag dispenser is generally indicated by the numeral 50. Bag dispenser 50 includes a liner or bag inventory and feed mechanism which can be in the form of a series of rolls, rollers, or spools which advantageously function to dispense flexible bags supplied on rolls to the container receiving area 40. The flexible bags or other liners are inserted into containers 41. If other configurations for the supplied liner are desired, then modifications may be needed.

The liner dispenser shown includes first and second rolls or spools 51 and 52. The first and second bag rolls 51 and 52 hold a supply of flexible bags or other liners. They also allow the supplied bags to be delivered to the container receiving area 40 for insertion of the flexible bags into containers 41. In the preferred embodiment, the flexible bags are supplied from a roll in which the individual flexible bags are advantageously interconnected end-to-end in a series. These can be divided into individual bags at transverse lines of weakness, such as at perforations. However, in addition to working with pre-perforated, pre-sealed roll stock, other types of flexible bag or other liner stock can be used. One alternative is plain tube stock that is sealed and cut on site. Such alternative bag feed material may also require appropriate modification to apparatus 1.

As shown in FIGS. 1, 2 and 3, the first and second bag rolls 51 and 52 are positioned so that they may provide the series of interconnected flexible bags to a first bag feed roller 54, then to a second bag feed roller 55, and finally to a third bag feed roller 56. These flexible bags are then dispensed to the container receiving area 40. The bags are typically fed one at a time with the leading flexible bag on the roll detached and inserted into open packaging container 42. A conventional actuating means (not shown) causes the series of interconnected bags to be controllably advanced, and supplied to the container receiving area 40. This is done at a suitable rate, such as one bag at a time.

In the preferred embodiment, the flexible bags are supplied from a roll in which the individual flexible bags are interconnected end-to-end in a series connected at transverse lines of weakness which form partition or tear lines. When the first flexible bag in the series of bags is dispensed to the container receiving area 40, several vacuum heads operate to engage the flexible bag. The bag is then opened by separating the two opposing leaves of the bag. The vacuum heads also separates the bag from the series of bags remaining on the roll and feed mechanism. Additionally, these vacuum heads serve to position the flexible bag for insertion into a container positioned in the container receiving area 40. The operation of these vacuum heads is described in greater detail hereinafter.

The Liner Engagement Vacuum Assembly

Now turning to FIGS. 1 and 5–8, the vacuum assembly is generally indicated by the numeral 70. As will be described in detail below, the vacuum assembly 70 serves to engage and position flexible bags which have been dispensed to the container receiving area 40 by the bag dispenser 50. In the preferred embodiment, the vacuum assembly 70 includes at least one, and more preferably at least two movable vacuum heads. In the preferred embodiment, at least one vacuum head is advantageously positioned along each side of the bag. The vacuum heads may be controllably moved to engage a flexible bag which has been supplied by the bag dispenser 50. Two rear vacuum heads assist the movable vacuum heads in engaging the flexible bag between opposing sets of vacuum heads.

Figure 5:
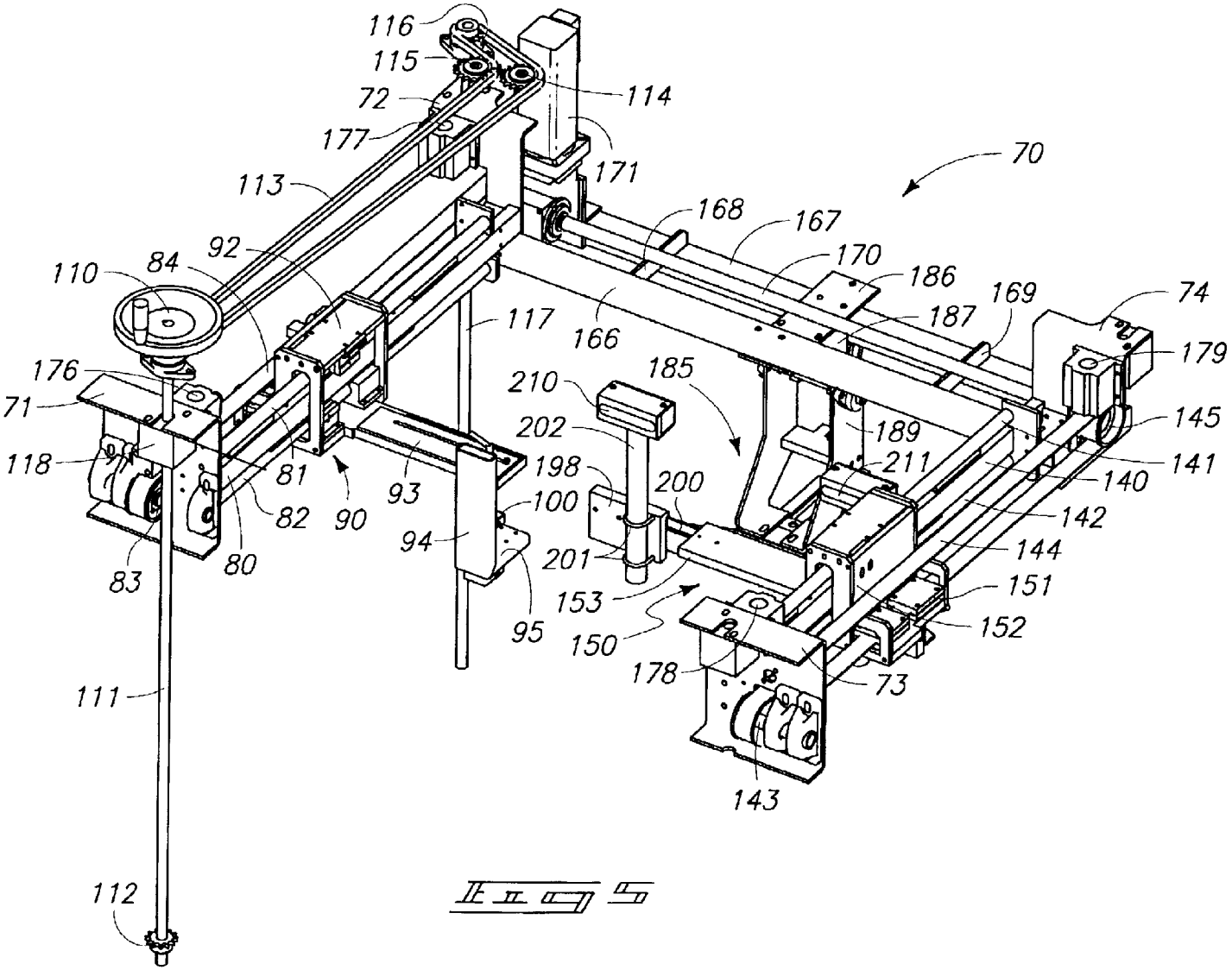
FIG. 5 is a perspective view showing portions of the vacuum assembly utilized in the packaging liner insertion apparatus of FIG. 1.
Figure 8:
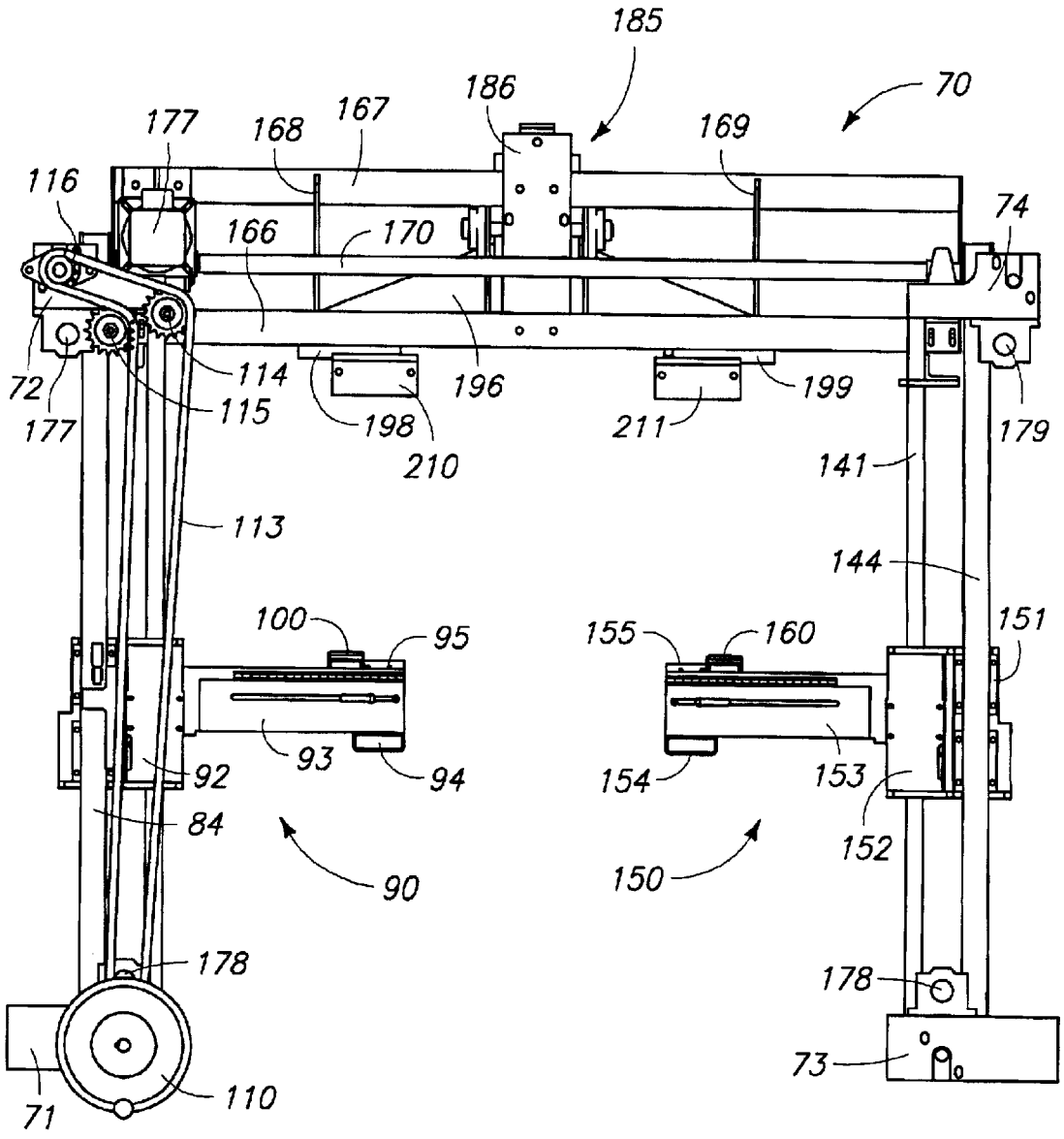
FIG. 8 is a top view showing portions of the vacuum assembly utilized in the packaging liner insertion apparatus of FIG. 1.

As best seen in FIGS. 5 and 8, the basic framework of the vacuum assembly 70 is essentially a "U" shaped structure. This U-shaped framework may be raised or lowered relative to the main framework 10 to accommodate a variety of container sizes. As will be further described below, one movable vacuum head is configured to travel along each side of the "U," while the two rear vacuum heads are positioned near the base of the "U" shaped framework. These two rear vacuum heads also move to assist in the engagement of the flexible bags, the separation of the flexible bags from the bag supply roll and the positioning of the flexible bags for insertion into open cartons or containers. Alternatively, the vacuum heads can all be mounted for substantial movement, such as for coordinated movement against the bag and then to spread the bag.

Referring again to FIGS. 1 and 5–8, the vacuum assembly 70 has four mounting plates: a front left mounting plate 71, a back left mounting plate 72, a front right mounting plate 73, and a back right mounting plate 74. These four mounting plates 71, 72, 73 and 74 generally define the four outer corners of the vacuum assembly 70.

As shown best in FIG. 5, the front left mounting plate 71 and the back left mounting plate 72 are connected by several structures, including: a left side frame support 80, a top left guide rod 81, and a bottom left guide rod 82. The left side frame support 80 rigidly attaches the front left mounting plate 71 to the back left mounting plate 72. The top left guide rod 81 and a bottom left guide rod 82 are designed to slidably receive the left movable vacuum subassembly which is described in detail below.

As best seen in FIGS. 5 and 7, a front left pulley 83 is also securely attached to the front left mounting plate 71 in such a way that the front left pulley may rotate freely. The front left pulley 83 is operably coupled with a left vacuum drive belt 84 which extends to, and is operably coupled with, a back left pulley 85. The back left pulley 85 is attached to the back left mounting plate 72.

Referring now to FIGS. 5 and 7, the left movable vacuum subassembly is generally designated by the numeral 90. The left movable vacuum subassembly 90 includes a left vacuum drive belt clamp 91 which functions to securely attach the left arm guide 92 to the left vacuum drive belt 84. As best seen in FIG. 5, the left horizontal vacuum segment 93 is affixed to the left arm guide 92, and extends horizontally therefrom. The left vertical vacuum segment 94 is securely connected to the left horizontal vacuum segment 93, and extends downwards therefrom, while the left vacuum connector 95 serves to securely couple the left vertical vacuum segment 94 to the movable left vacuum head 100. Together these structures comprise the left movable vacuum subassembly 90. Each part thereof can be connected so as to allow positional adjustment for positioning and aligning the vacuum heads.

When the left vacuum drive belt 84 is put into motion, the attached left vacuum subassembly 90, including the attached movable left vacuum head 100, will move with the left vacuum drive belt 84. The left movable vacuum subassembly 90 slidably moves along the top left guide rod 81 and the bottom left guide rod 82 as movement of the left vacuum drive belt 84 causes the attached left vacuum subassembly 90 to slidably travel along the left guide rods 81 and 82.

Figure 4:
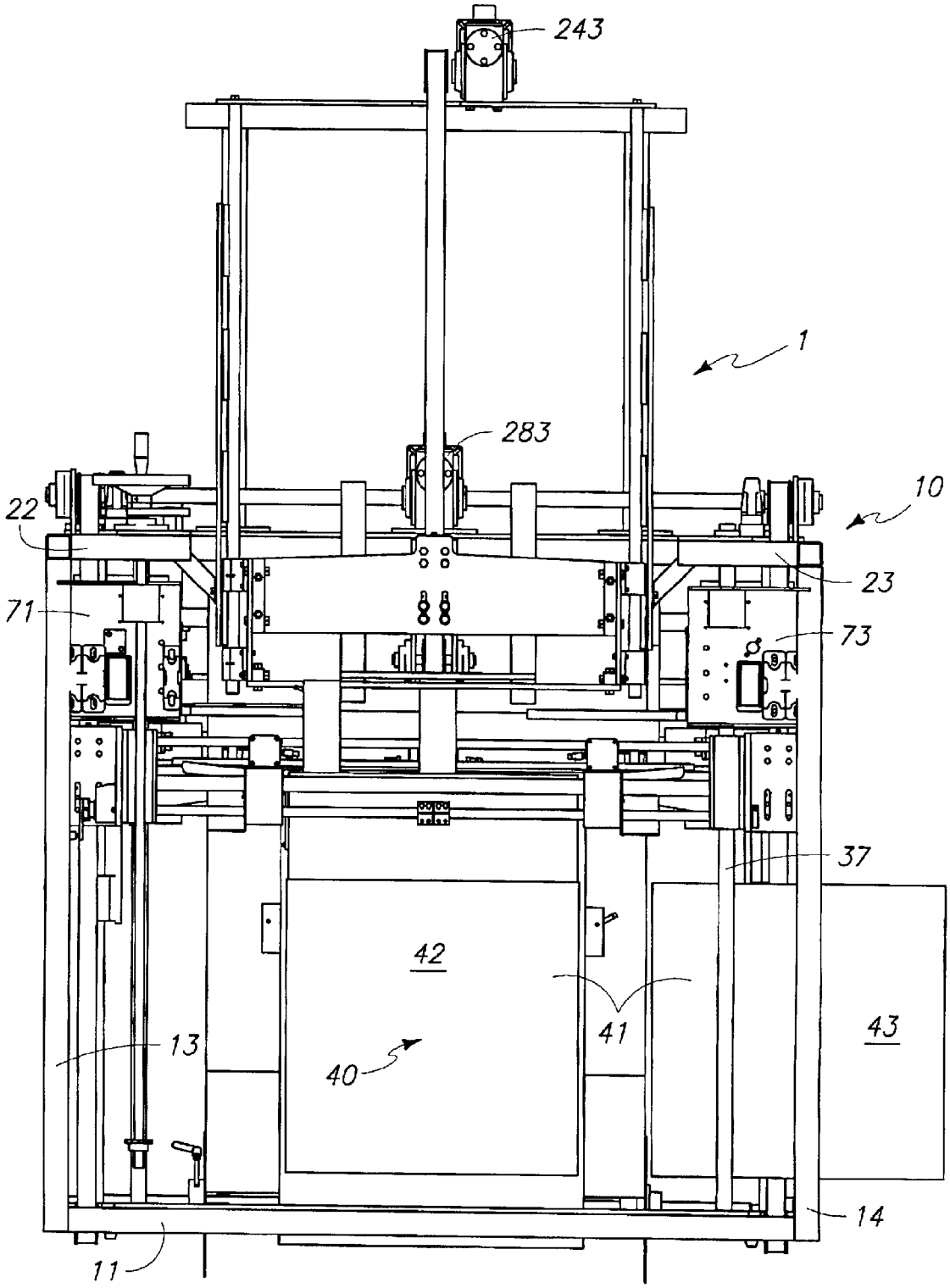
FIG. 4 is a front elevational view of the packaging liner insertion apparatus of FIG. 1.

Referring again to FIGS. 1 and 5–8, the upper adjusting handle 110 is shown positioned above the front left mounting plate 71. The upper adjusting handle 110 is securely connected to the front vacuum assembly adjustment rod 111. As best seen in FIGS. 4 and 5, the front adjustment rod 111 extends downward through the front left mounting plate 71 where it is slidably coupled to allow height adjustment. As shown, the front adjustment rod 111 is threadably coupled with front threadable height coupler 118. The lower end 112 of the front vacuum assembly adjustment rod 111 extends downward toward the lower front frame mounting plate 19.

As shown in FIGS. 5–8, vertical adjustment chain or belt 113 is operably coupled with the upper adjusting handle 110, so that turning the upper adjusting handle will cause the vertical adjustment chain 113 to move. As best seen in FIG. 5, the vertical adjustment chain 113 is further operably coupled with a first adjustment sprocket 114, a second adjustment sprocket 115, and a third adjustment sprocket 116. The third adjustment sprocket 116 is securely affixed to the rear vacuum assembly adjustment rod 117. The rear vacuum assembly adjustment rod 117 extends downward through the back left mounting plate 72. It is also movably coupled to allow height adjustment, and threadably couples with rear threadable coupler 119. After passing through the rear threadable coupler 119, the rear vacuum assembly adjustment rod 117 extends further downward toward the lower rear mounting plate 20.

When the upper adjusting handle 110 is manually turned, the attached front vacuum assembly adjustment rod 111 will also turn, and the vertical adjustment chain 113 will also be put in motion. Movement of the vertical adjustment chain 113 will cause the third adjustment sprocket 116 and attached rear vacuum assembly adjustment rod 117 to rotate. Therefore, when the upper adjusting handle 110 is turned, both the front vacuum assembly adjustment rod 111 and rear vacuum assembly adjustment rod 117 will turn simultaneously. By simultaneously turning the front and rear vacuum assembly adjustment rods 111 and 117 which threadably mate with the respective threadable vacuum couplers 118 and 119, the vacuum assembly 70 may be controllably raised or lowered.

As shown best in FIG. 5, the vacuum assembly 70 includes first, second, third and fourth linear bearings 176, 177, 178 and 179 which are located near the four corners of the vacuum assembly 70. These linear bearing are respectively securely affixed to the four mounting plates 71, 72, 73 and 74 which roughly define the four corners of the vacuum assembly 70. The first, second, third and fourth frame guide rods 36, 37, 38 and 39 are slidably received within the respective linear bearings at each corner of the vacuum assembly 70 as shown in FIG. 1. As the height of the vacuum assembly 70 is adjusted, the vacuum assembly 70 slidably moves up or down along these four frame guide rods 36, 37, 38 and 39. This vertical adjustment allows the apparatus 1 to accommodate a variety of container sizes, specifically container heights.

Now referring to FIGS. 5 and 8, the front right mounting plate 73 and the back right mounting plate 74 are also connected by several structures, including a right side frame support 140 which securely attaches the front right mounting plate 73 to the back right mounting plate 74. A top right guide rod 141 and a bottom right guide rod 142 also extend between the front right mounting plate 73 and the back right mounting plate 74. These right guide rods 141 and 142 are designed to slidably receive the right movable vacuum subassembly which is described in detail below. As best seen in FIG. 5, a front right pulley 143 is attached to the front right mounting plate 73 so that it may freely rotate. The front right pulley 143 is operably coupled with a right vacuum drive belt 144 which extends to and is operably coupled with a back right pulley 145. As shown in FIG. 5, the back right pulley 145 is attached to the back right mounting plate 74.

Referring again to FIGS. 5 and 8, and referring more to FIG. 8, the right movable vacuum subassembly is generally designated by the numeral 150. The right movable vacuum subassembly 150 includes a right vacuum drive belt clamp 151 which secures the right arm guide 152 to the right vacuum drive belt 151. The right horizontal vacuum segment 153 is securely attached to the right arm guide 152, and extends horizontally therefrom. The right vertical vacuum segment 154 is attached to the right horizontal vacuum segment 153, and extends downwardly therefrom. The right vacuum connector 155 serves to securely couple the right vacuum segment 154 to the movable right vacuum head 160.

Some of the components of the right movable vacuum subassembly are not shown in the fragmentary drawing of FIG. 5, as portions of the right movable vacuum subassembly have been removed to make the underlying structures visible. Therefore, some of these components are best seen in FIG. 8. However, the reader should appreciate that the right movable vacuum subassembly is essentially a mirror image of the left movable vacuum subassembly which is shown in FIG. 5. When the right vacuum drive belt 144 is put in motion, the attached right vacuum subassembly 150 including the attached movable right vacuum head 160 will slidably move along the top and bottom right guide rods 141 and 142.

Referring once again to FIGS. 5–8, the structures which are located at the rear of the U-shaped vacuum assembly which join the right and left halves of the vacuum assembly 70 will now be described. The back left mounting plate 72 and the back right mounting plate 74 are rigidly connected by a first rear cross member 166 and the second rear cross member 167 as shown. These cross members 166 and 167 are best observed in FIGS. 5 and 8. A first cross brace 168, and a second cross brace 169 serve to securely connect and stabilize the first and second rear cross members 166 and 167.

As best shown in FIGS. 5–9, a vacuum assembly drive axle 170 also spans the distance between the back left mounting plate 72 and the back right mounting plate 74 and is securely attached to the back left and back right pulleys 85 and 145. Rotational movement of the vacuum assembly drive axle 170 is driven by the vacuum assembly actuator or vacuum head operator 171. In the preferred embodiment, the vacuum assembly actuator 171 is a servomotor. However, in other embodiments pneumatic cylinders or other appropriate actuating means may be utilized.

The vacuum assembly actuator 171 may be operated to controllably cause the vacuum assembly drive axle 170 to rotate in either clockwise or a counterclockwise directions. Rotation of the vacuum assembly drive axle 170 causes the attached back left and back right pulleys 85 and 145 to rotate similarly. This rotation of the back left and back right pulleys 85 and 145 in turn drives the left and right vacuum drive belts 84 and 144, causing them to be put in motion. As the left and right vacuum drive belts 84 and 144 are controllably driven by the vacuum assembly actuator 171, the left and right movable vacuum assemblies 90 and 150 may be controllably moved along the respective left and right guide rods. The left movable vacuum assembly 90 travels along the top and bottom left guide rods 81 and 82 which are slidably received by the left movable vacuum assembly 90. The right movable vacuum assembly 150 travels along the top and bottom right guide rods 141 and 142 which are similarly slidably received by the right movable vacuum assembly 150.

Now referring to FIGS. 5–8, the back vacuum subassembly is generally indicated by the numeral 185. As mentioned above, in the preferred embodiment, the vacuum assembly 70 has an approximately U-shaped configuration and subframe as viewed from above. This arrangement allows a movable vacuum head to travel along each side. Two rear vacuum heads are positioned near the base of the U-shaped framework. The back vacuum subassembly 185 including these two rear vacuum heads will be described in detail hereinafter.

Referring to FIGS. 5–8, the top brace 186 of the back vacuum subassembly 185 is securely attached to the first and second rear cross members 166 and 167. The upper body 187 is attached to the lower surface of the top brace 186 and extends downwardly. The lower body 189 is pivotally attached to the upper body 187 at pivot joint 188. This pivotal attachment 188 allows the two rear vacuum heads to pivotally move backwards and downwards to facilitate the separation, opening and positioning of the flexible bags.

As best seen in FIG. 7, a tilt brace 193 securely attaches the upper body 187 to the rear vacuum head tilt actuator 194. The rear vacuum head tilt actuator 194 may be controllably moved to operate the connected rear tilt piece 195, exerting force against the rear tilt piece 195 and causing the lower body 189 to pivot at the pivot joint 188.

Figure 6:
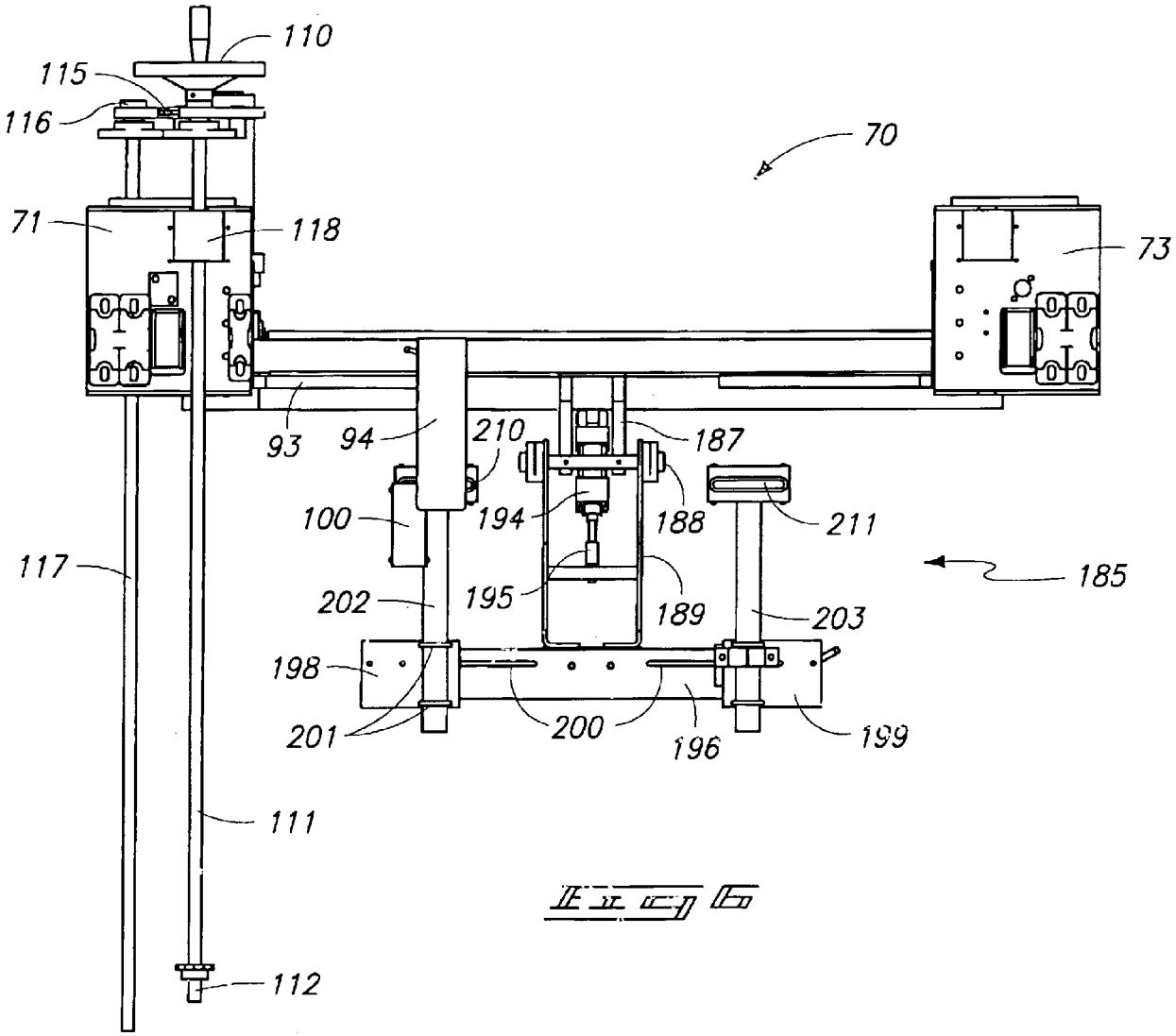
FIG. 6 is a front elevational view showing portions of the vacuum assembly utilized in the packaging liner insertion apparatus of FIG. 1.

Referring now to FIGS. 6 and 7, the lower body 189 is shown to be attached to the rear horizontal vacuum segment 196. As shown in the illustrations, the rear horizontal vacuum segment 196 is also attached to a pneumatic actuator 197. Pneumatic actuator 197 may be controllably extended or retracted to move the left and right rear vacuum heads 210 and 211, and to facilitate the positioning of the flexible bags which are to be inserted into a container. The left and right rear vacuum head mounting plates 198 and 199 are also attached to the rear horizontal vacuum segment 196.

As best shown in FIG. 6, two horizontal slots 200 are present in the rear horizontal vacuum segment 196. These horizontal slots 200 allow the position of the left and right rear vacuum head mounting plates 198 and 199 to be slidably adjusted and secured at various positions along the rear horizontal vacuum segment 196 to adjust the distance between the rear vacuum heads. Clamps 201 are shown to attach the left and right rear vacuum head mounting plates 198 and 199 to the respective left and right vertical vacuum tubes 202 and 203. As best seen in FIG. 6, the left rear vacuum head 210 is attached to the left vertical vacuum tube 202, while the right rear vacuum head 211 is similarly attached to the right vertical vacuum tube 203.

Referring now to FIG. 7, the operation of the rear vacuum head tilt actuator 194 is described. When the rear vacuum head tilt actuator 194 is moved, it will exert force against the rear tilt piece 195, causing the lower body 189 to pivot at pivot joint 188. This pivotal movement causes the two rear vacuum heads to move. When the actuator is contracted it causes the rear vacuum heads to move backwards and downwards to facilitate the separation, positioning and opening of the flexible bags which are received In the container receiving area. When the actuator is extended the rear vacuum heads move forwards and upwards into position for engaging the flexible bags.

The Insertion Assembly

Referring now to FIGS. 1, 9, 10 and 11, the insertion assembly is generally indicated by the numeral 230. As shown in the figures, the insertion assembly 230 is securely positioned on top of the main framework 10, and is attached to the upper rear frame mounting plate 35. A left inserter vertical member 231 and a right inserter vertical member 232 extend vertically upward from the upper rear frame mounting plate 35 to which they are securely affixed. A left inserter guide rod 233 is positioned in front of the left inserter vertical member 231, and is securely attached to the left inserter vertical member 231 by a left side plate 234. Similarly, a right inserter guide rod 235 is positioned in front of the right inserter vertical member 232, and is similarly attached to the right inserter vertical member 232 by a right side plate 236.

Figure 11:
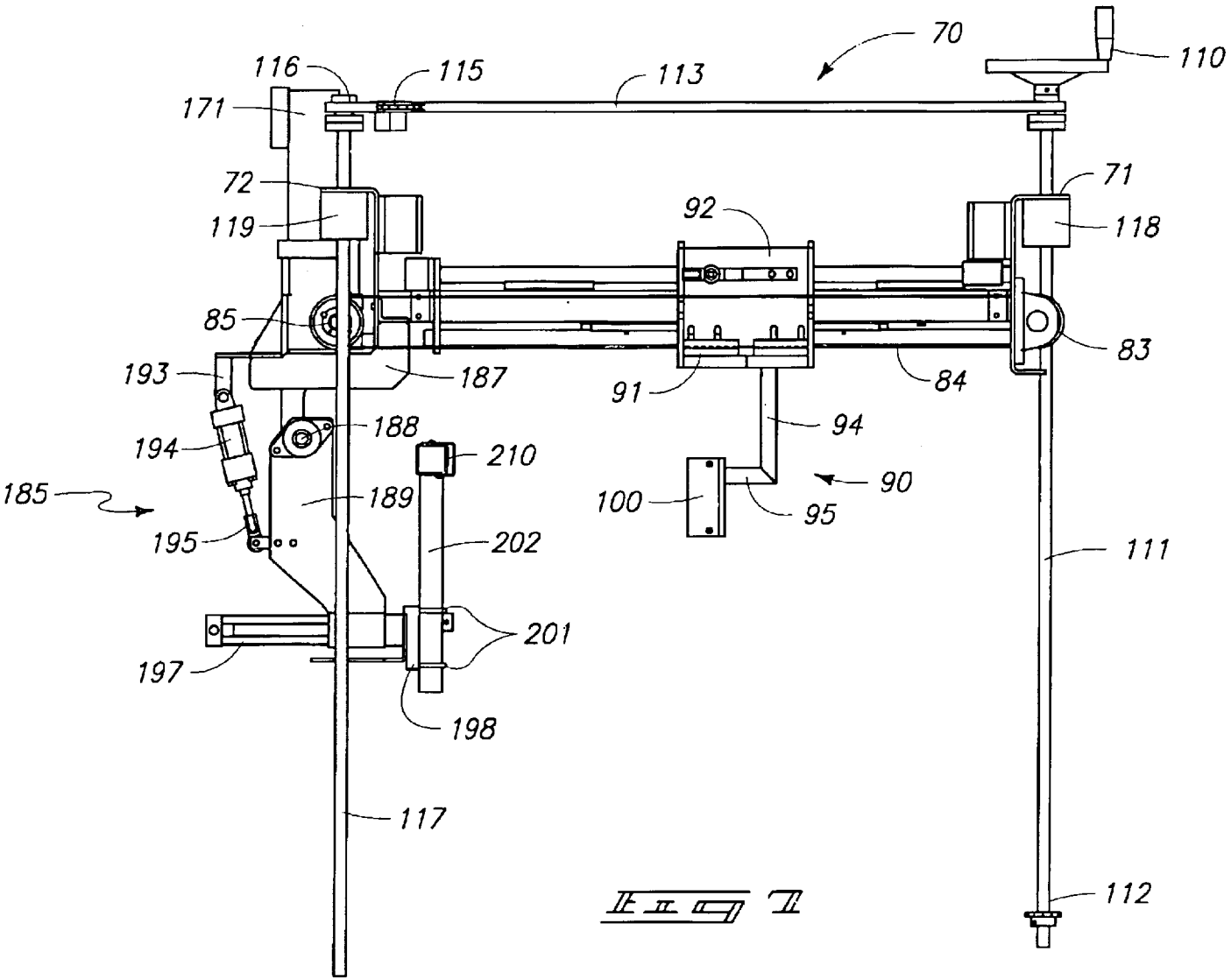
FIG. 11 is a front view showing portions of the packaging liner insertion apparatus of FIG. 1, again emphasizing the cuffing and insertion assemblies.
Figure 9:
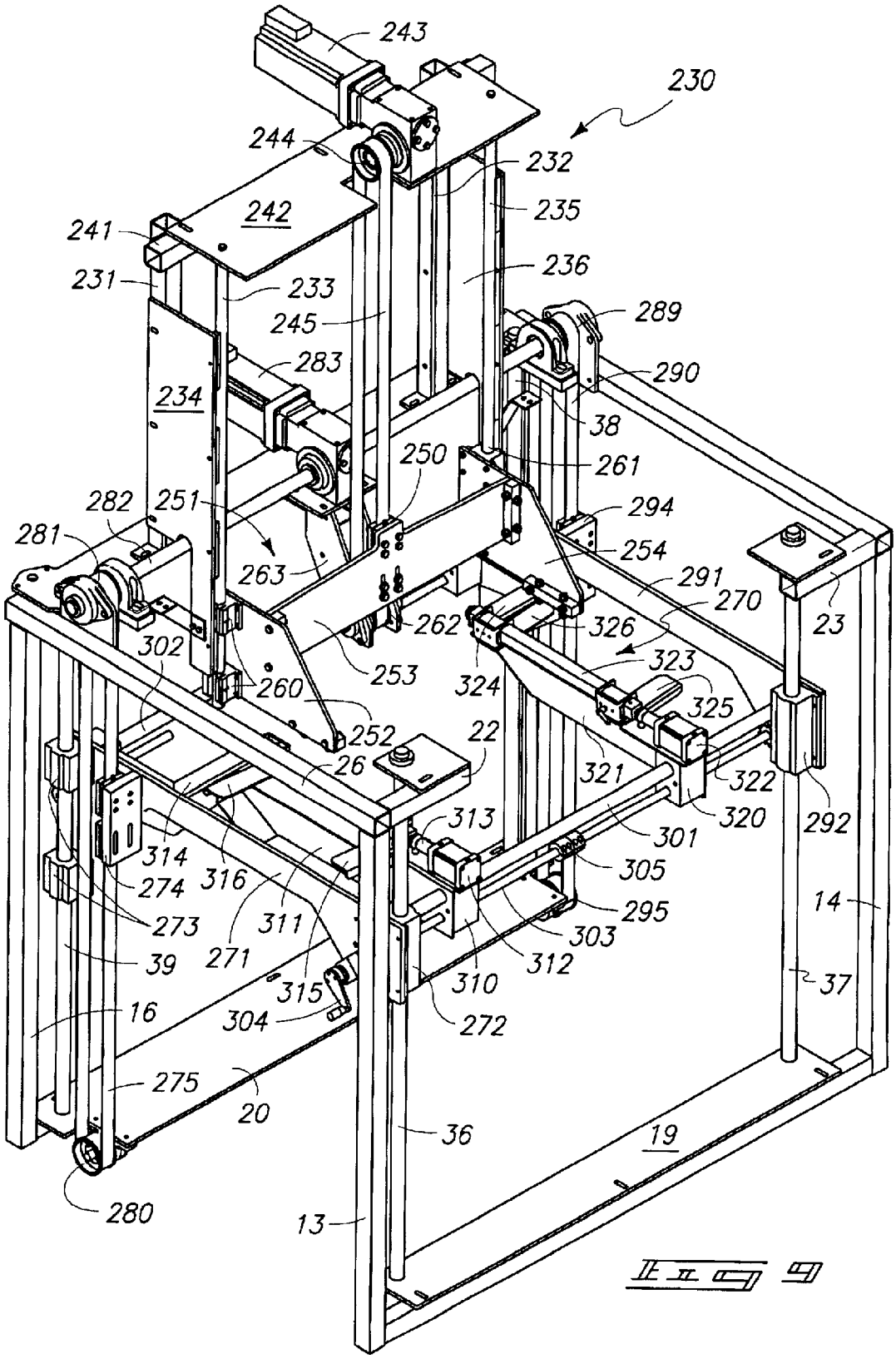
FIG. 9 is a perspective view showing portions of the packaging liner insertion apparatus of FIG. 1, emphasizing the cuffing and insertion assemblies.
Figure 11:
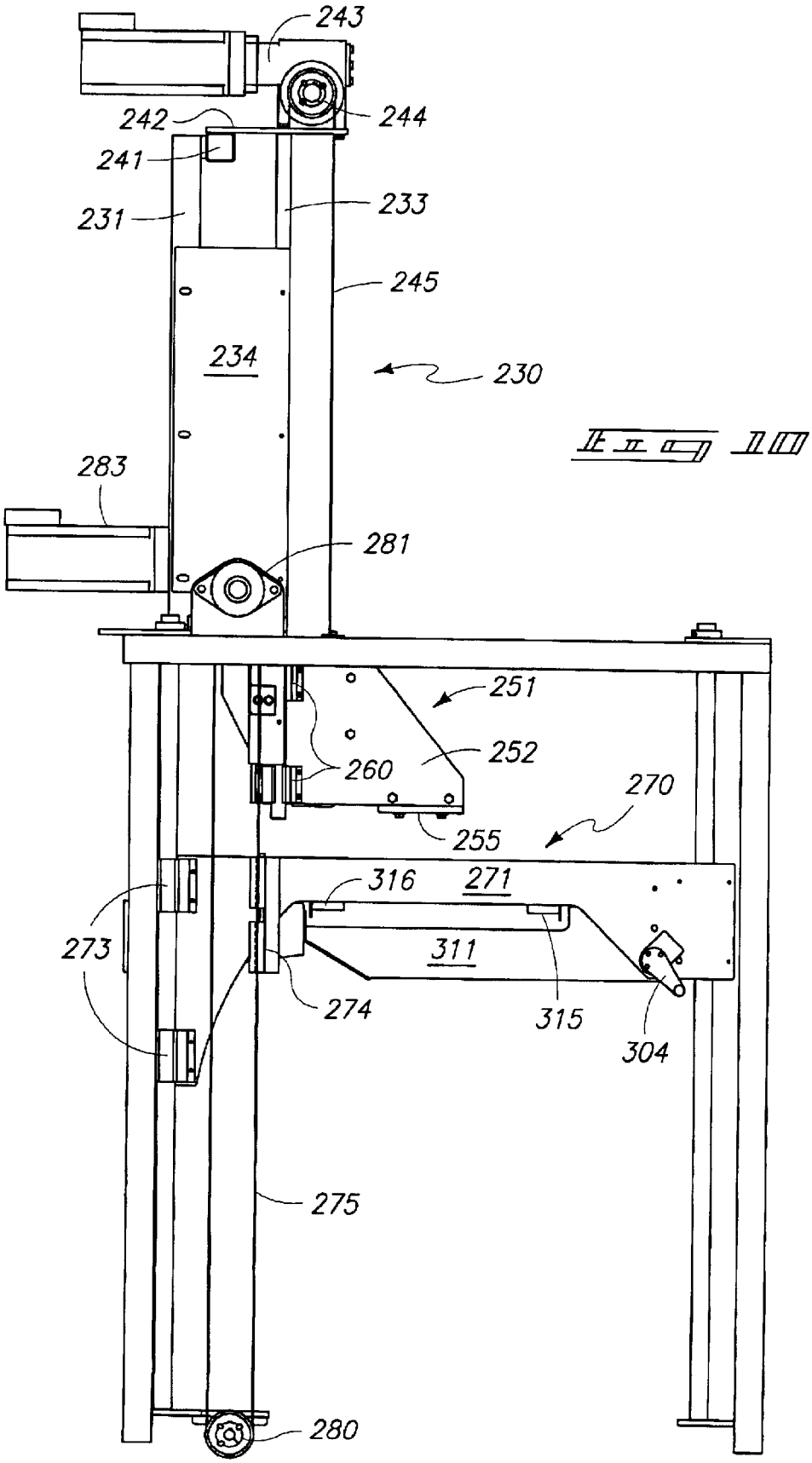

Referring to FIGS. 9 and 11, an inserter horizontal member 241 extends between and is securely attached to the upper ends of the left inserter vertical member 231 and a right inserter vertical member 232. As shown best in FIGS. 9 and 12, a top plate 242 covers and is securely affixed to the inserter horizontal member 241. This top plate 242 is also securely attached to the upper ends of the left and right inserter guide rods 233 and 235.

Again referring to FIGS. 1, 9, 10 and 11, an inserter actuator 243 is securely mounted on the top plate 242. In the preferred embodiment, the inserter actuator 242 is a servomotor. However, in other embodiments pneumatic cylinders or other appropriate actuating means may be utilized. The inserter actuator 243 drives a top pulley 244, causing the top inserter pulley 244 to controllably rotate. Inserter drive belt 245 is operably coupled with the top inserter pulley 244, which is driven by the inserter actuator 242. As shown best in FIGS. 9 and 11, an inserter drive belt clamping device 250 is securely attached to the inserter drive belt 245. The inserter drive belt clamping device 250 is also securely attached to the inserter support body generally indicated by the numeral 251.

Referring to FIG. 9, the inserter support body 251 includes: a left inserter support wall 252, a back inserter support wall 253, and a right inserter support wall 254 each of which are securely joined to form a unitary inserter support body 251. As shown in FIGS. 9, 10 and 11, left inserter linear bearings 260 are attached to the outside surface of the left inserter support wall 252. These left inserter linear bearings 260 slidably couple with the left inserter guide rod 233. Similarly, as best seen in FIG. 11, right inserter linear bearings 261 are attached to the outer surface of the right inserter support wall 254. The right inserter linear bearings 261 slidably couple with the right inserter guide rod 235.

Referring to FIGS. 9, 10 and 11, the lower end of the inserter drive belt 245 is shown to be operably coupled to a lower inserter pulley 262. As best seen in FIG. 9, the lower inserter pulley 262 is securely attached to lower inserter brace 263. The lower inserter brace 263 is securely affixed to the upper rear frame mounting plate 35. The inserter support body 251 is vertically slidably movable and is driven by the inserter actuator 243 which is operably coupled to the inserter drive belt 245. In the preferred embodiment, the insertion assembly 230 includes a mandrel 330 (FIG. 13) which is securely attached to the inserter support body 251 at the mandrel mounting surface 255.

As the inserter support body 251 and attached mandrel (not shown) travel downwardly, the mandrel will engage an opened flexible bag which is to be inserted into a container in the container receiving area. A flexible bag will previously have been engaged and positioned for insertion by the vacuum assembly 70, so that the mandrel will enter the flexible bag as the mandrel and inserter support body 251 slidably travels downwards. As the mandrel and flexible bag continue to move downwards, the flexible bag will be inserted into the container located in the container receiving area 40 below.

The Cuffing Assembly

Referring now to FIGS. 9–12, the cuffing assembly is generally indicated by the numeral 270. The cuffing assembly 270 has an essentially rectangular shaped framework, which is also vertically movable relative to the main framework 10. In the preferred embodiment, the cuffing assembly 270 generally comes into action and engages the flexible bag which is to be inserted before the insertion assembly 230 moves from the retracted to the extended positions. The cuffing assembly 270 functions to spread the open end of the flexible bag which is to be inserted into the container, and also functions to invert the open end of the flexible bag over the top edges of the container, thereby cuffing the flexible bag. In the preferred embodiment, cuffing of the flexible bag occurs simultaneously with the insertion process as the mandrel moves from the retracted to the extended position.

As best seen in FIGS. 9 and 10, the cuffing assembly 270 includes a left side brace 271 to which a left front cuffing assembly linear bearing 272 and left rear cuffing assembly linear bearings 273 are securely attached. The left front cuffing assembly linear bearing 272 matingly and slidably couples with the first frame guide rod 36. The left rear cuffing assembly linear bearings 273 matingly and slidably couples with the fourth frame guide rod 39.

Referring to FIGS. 9 and 10, the left side brace 271 is shown to be securely attached to a left cuffing assembly belt clamp 274. The left cuffing assembly belt clamp 274 is tightly clamped to the left cuffing assembly drive belt 275 so that the left side brace 271 will move with the left cuffing assembly drive belt 275. The left cuffing assembly drive belt 275 extends downwardly to the lower left cuffing assembly pulley 280, and upwardly to the upper left cuffing assembly pulley 281 as shown.

As shown best in FIGS. 9 and 11, the left cuffing assembly pulley 281 is affixed to the cuffing assembly drive shaft 282. The cuffing assembly drive shaft 282 is driven by cuffing actuator or actuating means 283. In the preferred embodiment, the cuffing actuator 283 is a servomotor. However, in other embodiments pneumatic cylinders or other appropriate actuating means may be utilized. The cuffing assembly drive shaft 282 also drives the upper right cuffing assembly pulley 289 which is securely affixed to the opposite end of the cuffing assembly drive shaft 282. The upper right cuffing assembly pulley 289 is further operably coupled with the right cuffing assembly drive belt 290.

Referring now to FIG. 9, the cuffing assembly 270 also includes a right side brace 291 to which a right front cuffing assembly linear bearing 292 and right rear cuffing assembly linear bearings (not shown) are securely attached. The right front cuffing assembly linear bearing 292 matingly and slidably couples with the second frame guide rod 37. The right rear cuffing assembly linear bearings (not shown) matingly and slidably couple with the third frame guide rod 38.

As shown in FIG. 9, the right side brace 291 is securely attached to a right cuffing assembly belt clamp 294. The right cuffing assembly belt clamp 294 is securely clamped to the right cuffing assembly drive belt 290. The right cuffing assembly drive belt 290 extends downwardly from the upper right cuffing assembly pulley 289 to the lower right cuffing assembly pulley 295 to which it is operably coupled.

When the cuffing actuator 283 is activated, it will turn the cuffing assembly drive shaft 282, causing it to controllably rotate in either a clockwise or counterclockwise direction. This controllable rotation of the cuffing assembly drive shaft 282 also causes the upper left and right cuffing assembly pulleys 281 and 289 which are affixed to the ends of the cuffing assembly drive shaft 282 to rotate. This rotation of the upper left and right cuffing assembly pulleys 281 and 289 in turn drives the left and right cuffing assembly drive belts 274 and 290, controllably raising or lowering the attached cuffing assembly 270.

Again referring to FIGS. 9–12, the left and right side bars 271 and 291 are connected by a front cuffing assembly rod 301, and by a rear cuffing assembly rod 302. The left and right side bars 271 and 291 are further connected by a front adjusting rod 303 which passes through the left side brace 271. Front adjusting rod 303 has a cuffing finger adjusting handle 304 located at its end. A cuffing assembly adjusting rod coupling 305 is located near the center of front adjusting rod 303 to couple the rod halves.

Referring again to FIGS. 9–12, a left cuffing finger guide block 310 is shown. The front cuffing assembly rod 301 and the front adjusting rod 303 pass through the left cuffing finger guide block 310. A left cuffing finger guide 311 extends rearwardly from the left cuffing finger guide block 310.

As shown best in FIG. 9, a left rotary actuator 312 is positioned on, and secured to the left cuffing finger guide block 310. A left pivot rod 313 extends from the left rotary actuator 312, eventually matingly coupling with a left support brace 314. The left support brace 314 is adjustably attached to the left side brace 271 so that the position of the left pivot rod 313 may be adjusted horizontally to accommodate a variety of container sizes.

Figure 12:
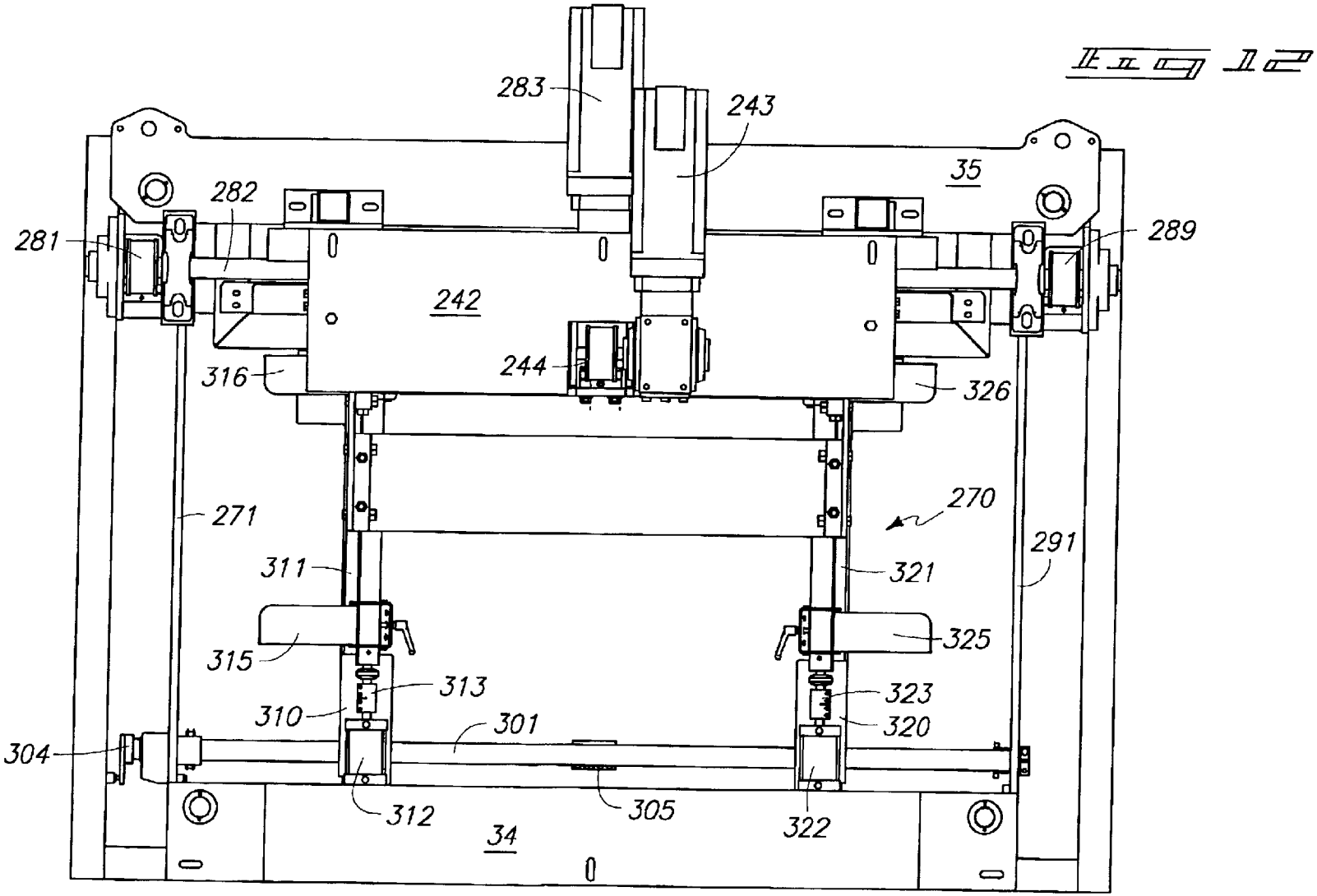
FIG. 12 is a top view showing portions of the packaging liner insertion apparatus, emphasizing the cuffing assembly.

As best understood by a review of FIGS. 9 and 12, the first and second left cuffing fingers 315 and 316 are attached to the left pivot rod 313. When left rotary actuator 312 is activated, the left pivot rod 313 will controllably rotate to move the first and second left cuffing fingers 315 and 316. The cuffing fingers move between a first position which facilitates the initial placement of the flexible bag into the container in the container receiving area, and a second position in which the cuffing fingers are adapted to spread the open end of the flexible bag to facilitate cuffing the bag over the top edges of the container.

Referring again to FIGS. 9–12, a right cuffing finger guide block 320 is also shown. The front cuffing assembly rod 301 and the front adjusting rod 303 pass through the right cuffing finger guide block 320. A right cuffing finger guide 321 extends rearwardly from the right cuffing finger guide block 320 as shown. As shown best in FIG. 9, a right rotary actuator 322 is positioned on, and secured to the right cuffing finger guide block 320. A right pivot rod 323 extends from the right rotary actuator 322, eventually matingly coupling with a right support brace 324. The right support brace 324 is adjustably attached to the right side brace 291 so that the position of the right pivot rod 323 may be adjusted horizontally to accommodate a variety of container sizes.

Referring still to FIGS. 9 and 12, the first and second right cuffing fingers 325 and 326 are attached to the right pivot rod 323. When right rotary actuator 322 is activated, the right pivot rod 323 will controllably rotate to move the first and second right cuffing fingers 325 and 326 between a first position which facilitates the initial placement of the flexible bag for insertion into the container in the container receiving area, and a second position in which the cuffing fingers are adapted to spread the open end of the flexible bag to facilitate cuffing the bag over the top edges of the container.

Referring now to FIGS. 9 and 11, the horizontal adjustment of the cuffing fingers is described hereinafter. As shown, the cuffing finger adjusting handle is positioned on the left side of apparatus 1. When the cuffing finger adjusting handle 304 is manually turned, the front adjusting rod 303 turns. Threaded followers within unit 310 and 320 cause the unit to move inward and outward in opposite directions as the cuffing finger adjusting handle 304 is turned. Coupling 305 couples two halves of shaft 303 together. This adjustment mechanism adjusts the horizontal distance separating the first and second left cuffing fingers 315 and 316 from the first and second right cuffing fingers 325 and 326. By adjusting this distance, the cuffing assembly 270 may be adjusted to accommodate a variety of container sizes.

The Mandrel

Figure 13:
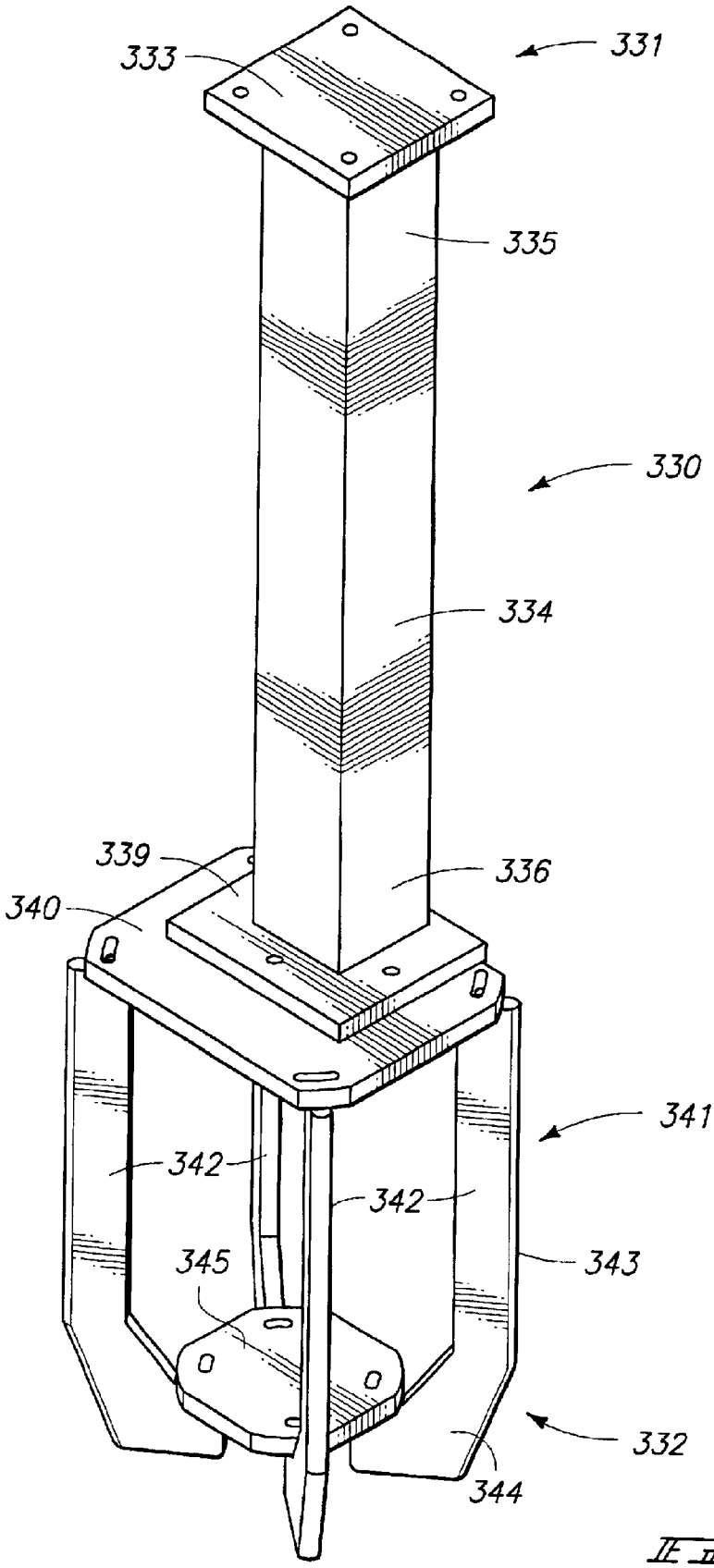
FIG. 13 is a perspective view showing a mandrel utilized with the packaging liner insertion apparatus of FIG. 1.
Figure 11:
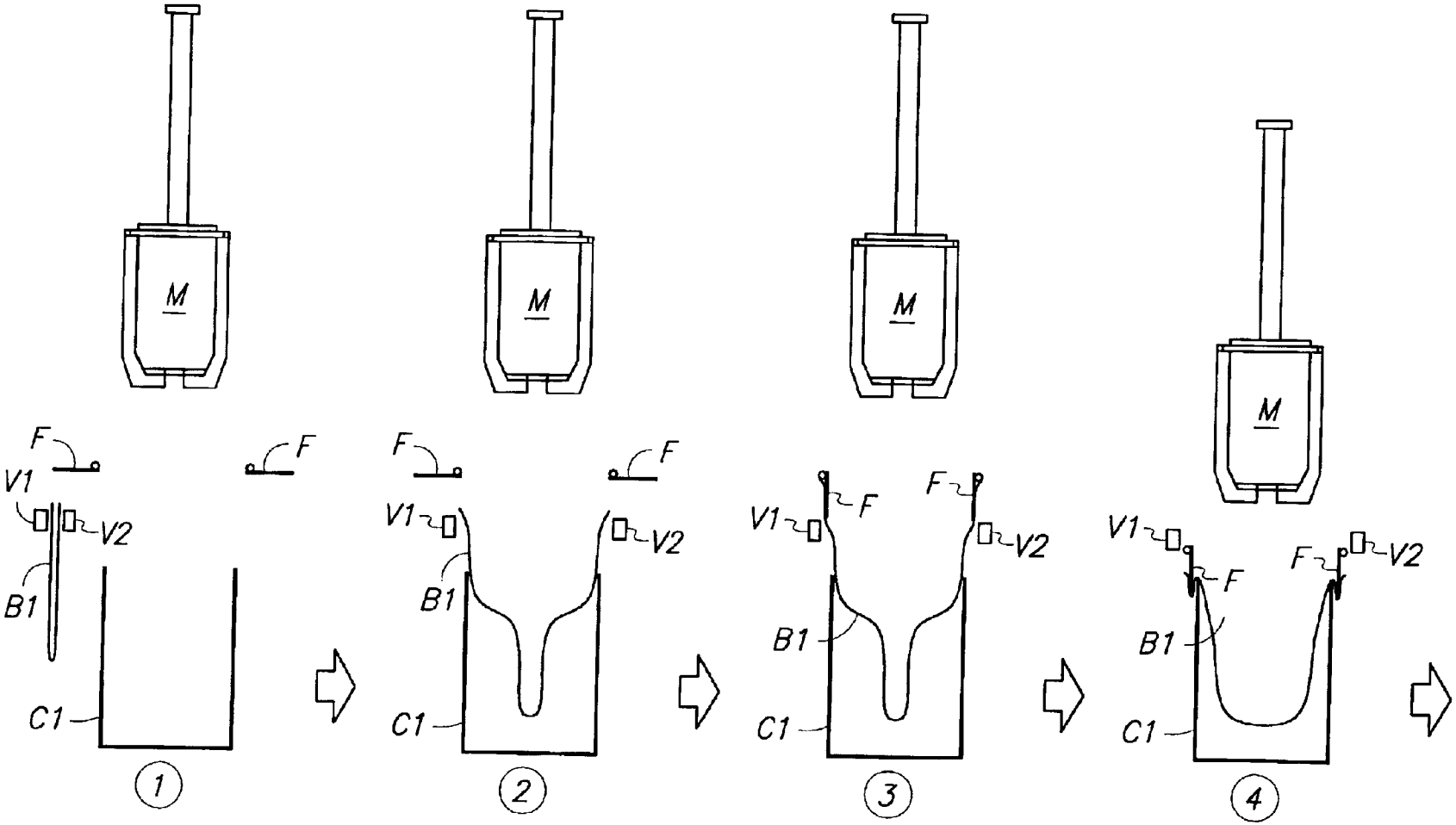
Figure 11:
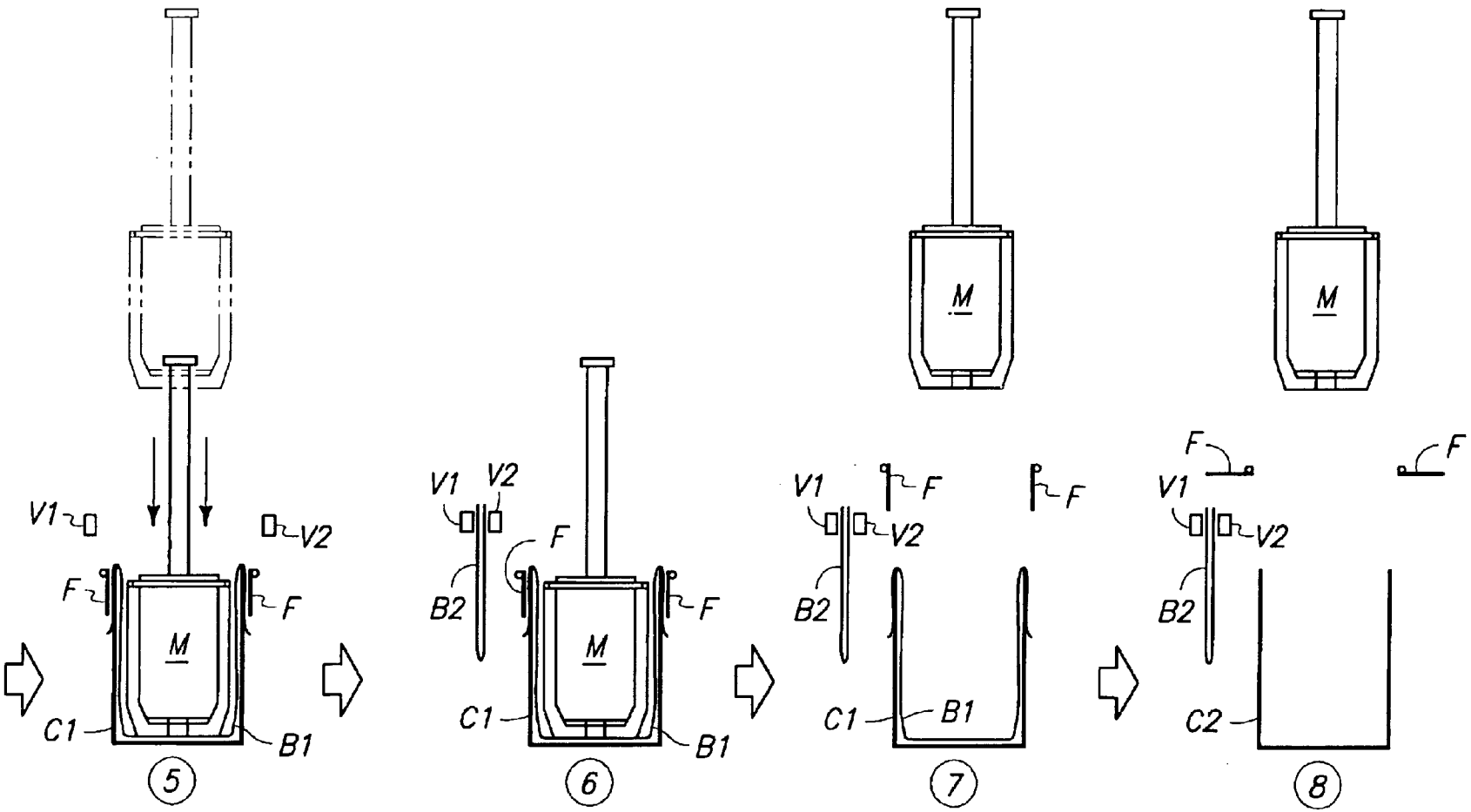
Figure 2:
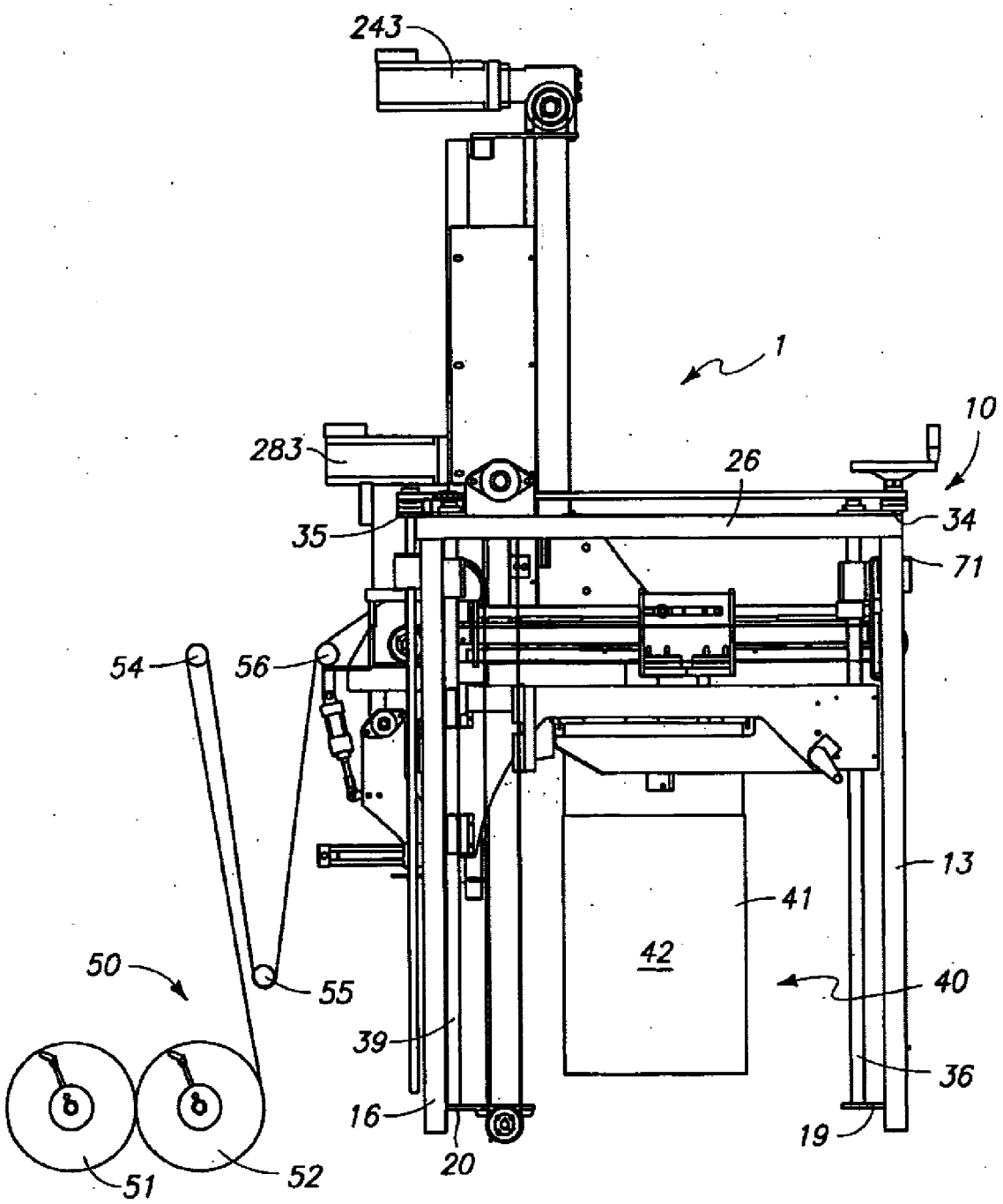

Now referring to FIGS. 1, 10 and 13, in a preferred embodiment, the apparatus of the present invention 1 includes a mandrel generally indicated by the numeral 330. The mandrel 330 has a mounting end 331 and an insertion end 332. A mandrel mounting plate 333 is positioned at the mounting end 331 of the mandrel 330. The mounting plate 333 functions to securely attach the mandrel 330 to the mandrel mounting surface 255 of the inserter support body 251 (FIG. 10).

Referring now to FIG. 13, a mandrel support member 334 having first and a second ends 335 and 336 is shown. The first end 335 of the mandrel support member 334 is rigidly affixed to the mounting plate 333 and extends therefrom. The second end 336 of the mandrel support member 334 is securely affixed to the lower mandrel mounting plate 339. The lower mandrel mounting plate 339 is securely attached to the upper surface of the mandrel head plate 340.

Still referring to FIG. 13, in a preferred embodiment, the mandrel head 341 is constructed from a plurality of diagonal plates 342 which are adapted to individually angle into the corners of the receiving cartons 41 (FIG. 1). Each of the diagonal plates has a vertical portion 343 and an angled lead portion 344. Each of the angled lead portions 344 are secured to a central block 345, which is positioned near the insertion end 332 of the mandrel 330.

In addition to the preferred embodiment described above, to accommodate a variety of packaging needs, mandrels of various shapes and sizes may be attached to the inserter support body 251. For example, other embodiments may utilize mandrels of various shapes to achieve the required fit for effective bag placement in cartons, drums, pails and other containers. In special applications, a custom made mandrel may be constructed and utilized. The particulars will vary depending on the size and shape of the container, and the size and shape of the bag or other liner which is to be inserted into the container. In one embodiment, a mandrel which discharges air to facilitate placement of the flexible bag into a container may be utilized. In other embodiments, a bullet shaped mandrel or bullet mandrel which discharges air as it enters the flexible bag may be utilized. Other mandrels can also be used, including other mandrels which discharge air or other suitable fluids.

Overview of the Process

Turning now to FIGS. 14A and 14B, simplified diagrammatic representation of a preferred method according to the present invention is shown. The method of inserting flexible bags into packaging cartons or other containers preferably includes the steps of: supplying cartons or containers to a container receiving area; dispensing flexible bags from a bag dispenser to a position adjacent to the container receiving area for insertion of the flexible bags into the containers; moving at least one moveable vacuum head to the bag dispenser to engage a flexible bag; engaging the flexible bag with the at least one movable vacuum head so that the flexible bag may be positioned for insertion into the container positioned in the container receiving area; moving the at least one movable vacuum head to position the flexible bag for insertion into the container positioned in the container receiving area; inserting the flexible bag into the container positioned in the container receiving area using an insertion apparatus having a mandrel; and moving the at least one movable vacuum head to the bag dispenser and into engagement with a subsequent flexible bag supplied by the bag dispenser while the mandrel is in an extended position having inserted the flexible bag into the container positioned within the container receiving area.

In the preferred embodiment, the method includes moving two movable vacuum heads to engage a flexible bag supplied by he bag dispenser, and utilizing two rear or relatively small movement vacuum heads to assist the moveable vacuum heads in engaging the flexible bag, separating the flexible bag from the supply roll and positioning the flexible bag for insertion into a container. However, other embodiments may include utilizing one or more movable vacuum head, and utilizing one or more rear or relatively small movement vacuum heads.

For the sake of clarity, the simplified diagrammatic representation of FIGS. 14A and 14B show only one movable vacuum head, and only one rear or relatively small movement vacuum head. The diagrams illustrate the method at select locations. As shown, the method is illustrated at eight preferred steps numbered 1–8, for convenience. Each of the steps described below refers to FIGS. 14A and 14B.

Step 1 shows a container C1 which has been supplied to the container receiving area. The top end of the container C1 is open so that a flexible bag B1 may be inserted into the container C1, and the open end of the flexible bag B1 cuffed over the top edges of the container C1. The diagram also shows a rear vacuum head V1 and a movable vacuum head V2. As shown in the diagram, the vacuum heads V1 and V2 have engaged the flexible bag B1 which has been supplied by the bag dispenser (not shown) so that they may position and open the flexible bag B1 for insertion into the open container C1.

The step 1 diagram also shows a mandrel M in the retracted position above the container C1. As shown, the mandrel M is axially aligned with the open container C1 below. Further, the diagram shows the cuffing fingers F in the first position to facilitate initial insertion of the flexible bag B1 into the container C1.

Step 2 shows that the movable vacuum head V2 has moved from the left to the right as it is opened. When opened, the flexible bag B1 is positioned for insertion into the container C1 below. As shown, V1 the rear vacuum head has also moved to assist in positioning the flexible bag B1 for insertion into the container C1. The diagram also shows the mandrel M which is still in the retracted position above the container C1. Still further, the diagram shows that the cuffing fingers F, which are still in the first position to facilitate initial insertion of the flexible bag B1 into the container C1.

Step 3 shows that cuffing fingers F, which have now moved or rotated to the second position in which the cuffing fingers F are adapted to spread the open end of the flexible bag B1 in preparation for inverting the open end of the flexible bag B1 over the top edges of the container C1. The diagram also shows the mandrel M which is still in the retracted position above the container C1. As shown, the mandrel M is axially aligned with the open container C1 below. Vacuum plenums V1 and V2 disengage from the bag after the cuffing fingers F have rotated into the position shown in step 3.

Step 4 shows the cuffing fingers F in the second position in which the cuffing fingers F are adapted to spread the open end of the flexible bag B1 and invert the open end of the flexible bag B1 over the top edges of the container C1. As shown in the drawing, the cuffing fingers F are moving downward, as they cuff the flexible bag B1 over the top edges of the container C1. Still further, the mandrel M is shown to be moving from the retracted position to the extended position, moving downward to insert the flexible bag B1 into the container C1 below. The insertion and cuffing of the flexible bag B1 occur simultaneously.

Step 5 shows the mandrel M moving from the retracted to the extended positions as it inserts the flexible bag B1 into the container C1 below. At this point, the vacuum heads V1 and V2 begin to return to their initial position so that a subsequent flexible bag B2 may be engaged.

Step 6 shows the mandrel M in the fully extended position. As shown, the mandrel M is now positioned within the container C1 in the container receiving area, having fully inserted the flexible bag B1 into the container C1. The vacuum heads V1 and V2 have returned to their initial locations and have engaged a subsequent flexible bag B2 which was supplied by the bag dispenser (not shown).

Step 7 shows the mandrel M, which has returned to its retracted position above the container C1. Th vacuum heads V1 and V2 are in their initial locations and have engaged a subsequent flexible bag B2 supplied by the bag dispenser (not shown). As shown, the cuffing fingers F are now retracted from container C1 and begin to return to their first position.

Step 8 shows a subsequent container C2 which has been supplied to the container receiving area. The top end of the subsequent container C2 is open so that a flexible bag B2 may be inserted into the container C2, and the open end of the flexible bag B2 cuffed over the top edges of the container C2. The diagram also shows a rear vacuum head V1 and a movable vacuum head V2. As shown in the diagram, the two vacuum heads V1 and V2 have engaged the flexible bag B2 which has been supplied by the bag dispenser (not shown) so that they may position and open the flexible bag B2 for insertion into the open container C2. The diagram also shows mandrel M in the retracted position above the container C2. As shown, the mandrel M is axially aligned with the open container C2 below. Further, the diagram show the cuffing fingers F in the first position to facilitate initial insertion of the flexible bag B2 into the container C2.

At this point a complete cycle has been completed. As shown, step 8 is similar to step 1. However, now a subsequent flexible bag B2 is to be inserted and cuffed in a subsequent container C2. This process may be sequentially repeated so that a plurality of flexible bags may be inserted into a plurality of containers and cuffed. As described above, the containers may be supplied to the container receiving area by a conventional conveyor belt or any other suitable means.

Operation and Further Aspects of Methods of the Preferred Embodiments

The operation of the described embodiments of the present invention is believed to be readily apparent and is briefly summarized at this point. In its broadest aspect, the present invention relates to a packaging insertion apparatus 1 for inserting flexible bags or other liners into packaging containers 41. The packaging insertion apparatus 1 includes, a bag dispenser 50 for dispensing flexible bags which are to be inserted into containers 41; an insertion assembly 230 which moves between a retracted position where the insertion assembly 230 is ready to insert a flexible bag into a container 42, and an extended position where the insertion assembly 230 is positioned within the container 42 having inserted the flexible bag into the container 42; and at least one movable vacuum head for engaging and positioning the flexible bags supplied by the bag dispenser 50 in preparation for insertion of the flexible bags into the containers 41, wherein the at least one movable vacuum head may engage a flexible bag supplied by the bag dispenser 50 while the insertion assembly 230 is in the extended position.

As disclosed above, in the preferred embodiment, the at least one movable vacuum head includes two movable vacuum heads 100 and 160, each of which may be controllably moved along separate paths on opposite sides of the insertion assembly 230 to engage a flexible bag held by the bag dispenser 50 while the insertion assembly 230 is in the extended position. Further, the preferred embodiment includes at least one rear vacuum head which may be controllably moved to assist the at least one movable vacuum head in engaging the flexible bag held by the bag dispenser 50. Still further, in other embodiments, the at least one movable vacuum head includes a plurality of movable vacuum heads.

In the preferred embodiment, the insertion assembly 230 includes a mandrel 330 for engaging or otherwise displacing the flexible bags which are to be inserted into the containers 41. The mandrel 330 travels with the insertion assembly 230 as it moves between the retracted position and the extended position.

In other embodiments, a bullet shaped mandrel (not shown) may be utilized, and may discharge air as it enters the flexible bag, to facilitate placement of the flexible bag within the container. Other mandrels including others that discharge air or other suitable fluids may also be used.

In the preferred embodiment, the packaging insertion apparatus 1 includes a cuffing assembly 270 adapted for use in cuffing an open end of the flexible bag over top edges of the container 42 into which the flexible bag was inserted. As disclosed above, the cuffing assembly 270 includes at least one actuating means 283 for raising and lowering the cuffing assembly 270, and further includes two pairs of cuffing fingers 315, 316 and 322, 326 positioned on two opposing sides of the container 42. Further, in the preferred embodiment, the cuffing assembly 270 includes two separate rotary actuators 312 and 322 operably coupled to the cuffing fingers. Still further, in the preferred embodiment, the cuffing fingers 315, 316 and 322, 326 are not mounted on the insertion assembly 230, and are operable to rotate inwardly and then cuff the open end of the flexible bag over the top edges of the container 42. This cuffing operation can be performed while the insertion assembly 230 is in the retracted position, while the insertion assembly 230 is in the extended position, and may also be performed simultaneously with the insertion of the flexible bag, while the insertion assembly 230 is moving between the retracted and extended positions.

In other embodiments, the cuffing assembly 270 may include at least one cuffing finger positioned on two opposing sides of the container; and at least one actuating means operably coupled to the cuffing fingers for selectively moving the cuffing fingers between a first position to facilitate initial insertion of the flexible bag into the container 42, and a second position in which the cuffing fingers are adapted to spread the open end of the flexible bag and invert the open end of the flexible bag over the top edges of the container 42.

In another aspect, the present invention relates to a packaging insertion apparatus 1 for inserting flexible bags into packaging containers 41, which includes, a container receiving area 40 for receiving containers 41 being supplied to the insertion apparatus 1; a bag dispenser 50 for dispensing flexible bags to the container receiving area 40 for insertion of the flexible bags into the containers 41; at least one movable vacuum head for engaging a flexible bag supplied by the bag dispenser to allow the flexible bag to be positioned for insertion into a container 42 held in the container receiving area 40; at least one vacuum head operator or actuator 171 for moving the at least one movable vacuum head into engagement with the flexible bag supplied by the bag dispenser 50 and for positioning the flexible bag for insertion into the container 42 held in the container receiving area 40; at least one insertion assembly 230 having a mandrel for engaging the flexible bag which is to be inserted into the container 42 held in the container receiving area 40, wherein the insertion assembly 230 has a retracted position where the mandrel 330 is ready to engage and insert the flexible bag into the container 42 in the container receiving area 40, and an extended position where the mandrel 330 is positioned within the container 42 in the container receiving area 40 having inserted the flexible bag into the container 42; and the at least one movable vacuum head movable into engagement with a flexible bag supplied by the bag dispenser 50 while the mandrel 330 is in the extended position.

In the preferred embodiment each movable vacuum head 100 and 160 may be controllably moved along separate paths on opposite sides of the mandrel 330, to engage a flexible bag supplied by the bag dispenser 50, while the mandrel 330 is in the extended position. In other embodiments, the at least one movable vacuum head may be controllably moved along at least one path past the mandrel 330, to engage a flexible bag supplied by the bag dispenser, while the mandrel 330 is in the extended position.

In the preferred embodiment, the packaging insertion apparatus 1 includes two rear vacuum heads 210 and 211 which may be controllably moved to assist the at least one movable vacuum head in engaging the flexible bag held by the bag dispenser. In other embodiments, the at least one rear vacuum head may be controllably moved to assist the at least one movable vacuum head in engaging the flexible bag held by the bag dispenser.

In other embodiments, the present invention includes at least one cuffing finger positioned on two opposing sides of the container; and at least one actuating means operably coupled to the cuffing fingers for selectively moving the cuffing fingers between a first position to facilitate initial placement of the mandrel and the flexible bag into the container, and a second position in which the cuffing fingers are adapted to spread the open end of the flexible bag and invert the open end of the flexible bag over the top edges of the container.

In the preferred embodiment of the present invention, the cuffing fingers are not mounted on the insertion assembly 230. The cuffing fingers are operable to cuff the open end of the flexible bag over the top edges of the container 42 while the mandrel 330 is in the retracted position. Alternatively or additionally, the cuffing fingers are operable to cuff the open end of the flexible bag over the top edges of the container 42 while the mandrel 330 is in the extended position. Further, the cuffing fingers are also operable to cuff the open end of the flexible bag over the top edges of the container 42 while the mandrel 330 is moving between the retraced and extended positions.

The method of inserting flexible bags into packaging containers 41 of the present invention includes the steps of, dispensing flexible bags from a bag dispenser 50 for insertion of the flexible bags into containers 41; engaging a flexible bag supplied by the bag dispenser 50 with at least one movable vacuum head; positioning the flexible bag for insertion into a container 42 by moving the at least one movable vacuum head; inserting the flexible bag into the container 42 with an insertion assembly 230, by moving the insertion assembly 230 to an extended position; and engaging a subsequent flexible bag held by the bag dispenser 50 with the at least one movable vacuum head while the insertion assembly 230 is in the extended position having inserted the flexible bag into the container 42.

In the method of the present invention the moving at least one moveable vacuum head to the bag dispenser 50 to engage a flexible bag comprises moving two movable vacuum heads 100 and 160 along separate paths on opposite sides of the insertion assembly 230 toward the bag dispenser 50 to engage the flexible bag supplied by the bag dispenser 50. Further, engaging the flexible bag comprises bringing the at least one vacuum head into apposition with the flexible bag supplied by the bag dispenser 50 and developing sufficient vacuum pressure so that the flexible bag will substantially adhere to the at least one movable vacuum head. Still further, moving the vacuum head to position the flexible bag for insertion into the container 42 in the container receiving area 40 includes moving at least a portion of an open end of the flexible bag so that the open end of the flexible bag will accept the insertion assembly 230. Still further, the method of the present invention may also include cuffing an open end of the flexible bag over top edges of the container 42 into which the flexible bag was inserted.

The method of inserting flexible bags into packaging containers 41 of the present invention also includes the steps of, supplying containers 41 to a container receiving area 40; dispensing flexible bags from a bag dispenser 50 to the container receiving area 40 for insertion of the flexible bags into the containers 41; moving at least one moveable vacuum head to the bag dispenser 50 to engage a flexible bag; engaging the flexible bag with the at least one vacuum head so that the flexible bag may be positioned for insertion into the container 42 positioned in the container receiving area 40; moving the vacuum head to position the flexible bag for insertion in to the container 42 positioned in the container receiving area 40; inserting the flexible bag into the container 42 positioned in the container receiving area 40 using an insertion apparatus 230 having a mandrel 330; and moving the at least one movable vacuum head to the bag dispenser 50 and into engagement with a subsequent flexible bag supplied by the bag dispenser 50 while the mandrel 330 is in an extended position having inserted the flexible bag into the container 42 positioned within the container receiving area 40.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A packaging insertion apparatus for inserting flexible bags into packaging containers, comprising:

a container receiving area for receiving containers being supplied to the insertion apparatus;

a bag dispenser for dispensing flexible bags to a position adjacent the container receiving area for insertion of the flexible bags into the containers;

at least one movable vacuum head for engaging flexible bag supplied by the bag dispenser to allow the flexible bag to be positioned for insertion into a container positioned in the container receiving area;

at least one vacuum head operator for moving the at least one movable vacuum head into engagement with the flexible bag supplied by the bag dispenser and for positioning the flexible bag for insertion into the container held in the container receiving area;

at least one insertion assembly having a mandrel or engaging the flexible bag which is to be inserted into the container held in the container receiving area, wherein the insertion assembly has a retracted position where the mandrel is ready to engage and insert the flexible bag into the container in the container receiving area, and an extended position where the mandrel is positioned within the container in the container receiving area having inserted the flexible bag into the container;

wherein the at least one movable vacuum head is movable into engagement with a subsequent flexible bag held by the bag dispenser while the mandrel is in the extended position.

2. The apparatus of claim 1, wherein the at least one movable vacuum head includes two movable vacuum heads.

3. The apparatus of claim 1, wherein the at least one movable vacuum head includes a plural of movable vacuum heads.

4. The apparatus of claim 1, wherein the at least one movable vacuum head may be controllably moved to engage th flexible bag supplied by the bag dispenser while the mandrel is in the extended position.

5. The apparatus of claim 2, wherein each of the movable vacuum heads may be controllably moved along opposite sides of the mandrel to engage the flexible bag supplied by the ba dispenser, and which may further be controllably moved to assist in positioning the flexible bag for insertion into the container.

6. The apparatus of claim 1, and further comprising at least one rear vacuum head which may be controllably moved to assist the at least one movable vacuum head in engaging the flexible bag held by the bag dispenser.

7. The apparatus of claim 1, and further comprising a cuffing assembly adapted for use in cuffing an open end of the flexible bag over top edges of the container into which the flexible bag was inserted.

8. The apparatus of claim 7, wherein the cuffing assembly comprises:

at least one cuffing finger positioned on two opposing sides of the container;

at least one actuating means operably coupled to the cuffing fingers for selectively moving the cuffing fingers between a first position to facilitate initial placement of the mandrel and the flexible bag into the container, and a second position in which the cuffing fingers are adapted to spread the open end of the flexible bag and invert the open end of the flexible bag over the top edges of the container; the at least one actuating means including two separate rotational actuating means for selectively moving the cuffing fingers between the first position and the second position.

9. The apparatus of claim 7, wherein the insertion assembly includes a mandrel.

10. A method of inserting flexible bags into packaging containers, comprising the steps of:

dispensing flexible bags from a bag dispenser for insertion of the flexible bags into containers;

engaging a flexible bag supplied by the bag dispenser with at least one movable vacuum head;

positioning the flexible bag for insertion into a container by moving the at least one movable vacuum head;

inserting the flexible ba into the container with an insertion assembly, by moving the insertion assembly to an extended position; and engaging a subsequent flexible bag held by the bag dispenser with the at least one movable vacuum head while the insertion assembly is in the extended position having inserted the flexible bag into th container.

11. A method according to claim 10, wherein after the inserting, the method further comprises cuffing an open end of the flexible bag over top edges of the container into which the flexible bag was inserted.

12. The method of claim 10, wherein the moving at least one moveable vacuum head to the bag dispenser to engage a flexible bag comprises moving two movable vacuum heads long separate paths on opposite sides of the insertion assembly toward the bag dispenser to engage the flexible bag supplied by the bag dispenser.

13. The method of claim 10, wherein the engaging the flexible bag comprises bringing the at least one vacuum head into apposition with the flexible bag supplied by the bag dispense and developing sufficient vacuum pressure so that the flexible bag will substantially a here to the at least one movable vacuum head.

14. The method of claim 10, wherein the moving the vacuum head to position the flexible bag for insertion into the contain in the container receiving area comprises moving at least a portion of an open end of the flexible bag so that the open end of the flexible bag will accept the insertion assembly.

15. A method of inserting flexible bags into packaging containers, comprising the steps of:

supplying containers to a container receiving area;

dispensing flexible bag from a bag dispenser to the container receiving area for insertion of the flexible bags into the containers;

moving at least one moveable vacuum head to engage a flexible bag;

engaging the flexible bag with the at least one vacuum head so that the flexible bag may be positioned for insertion into the container positioned in the container receiving area;

moving the vacuum head to position the flexible bag for insertion into the container positioned in the container receiving area;

inserting the flexible bag into the container positioned in the container receiving area using an insertion apparatus; and moving the at least on vacuum head to the bag dispenser and into engagement with a subsequent flexible bag supplied by the bag dispenser while the insertion apparatus is in an extended position having inserted the flexible bag into the container positioned within the container receiving area.

16. An apparatus for inserting a flexible liner into a packaging container, comprising:

a liner supply for supplying a flexible liner to be inserted into a container; at least one liner engagement head for controllably engaging a flexible liner supplied by the liner supply and positioning the liner for insertion into a container positioned in a container receiving area;

at least one insertion assembly which is movable between retracted and extended positions, said at least one insertion assembly being movable into an extended position to insert a liner into a container positioned in the container receiving area;

wherein said at least on liner engagement head is movable into engagement with a liner held by the liner supply while the at least one insertion assembly is in an extended position inserting another liner into a container positioned in the container receiving area.

17. An apparatus according to claim 16 and wherein said at least one liner engagement head includes at least one movable liner engagement head that is mounted to move and open a liner by separating two opposing leaves of the liner.

18. An apparatus according to claim 16 and wherein the liner supply is a dispenser that supplies liners from a roll.

19. An apparatus according to claim 16 and wherein said at least one liner engagement head includes at least one vacuum engagement head that applies vacuum when engaging a liner.

20. An apparatus according to claim 16 and wherein:

said at least one liner engagement head includes at least one vacuum engagement head that applies vacuum when engaging a liner;

said at least one liner engagement head includes at least one movable liner engagement head that is mounted to move and open a liner by separating two opposing leaves of the liner.

21. An apparatus according to claim 16 and wherein said at least one liner engagement head includes a plurality of vacuum engagement heads that apply vacuum when engaging a liner.

22. An apparatus according to claim 16 and wherein said at least one liner engagement head includes at least two opposing liner engagement heads that are in opposed relationship and engage opposing leaves of a liner.

23. An apparatus according to claim 16 and wherein:

said at least one liner engagement head includes at least two opposing liner engagement heads that are in opposed relationship and engage opposing leaves of a liner;

said at least one line engagement head also including at least one vacuum engagement head that applies vacuum when engaging a liner.

24. An apparatus according to claim 16 and wherein:

said at least one liner engagement head include at least two pair of opposing liner engagement heads, each pair of opposing liner engagement heads having opposing liner engagement heads that are in opposed relationship and engage opposing leaves of a liner;

said at least two pair of opposing liner engagement heads being mounted with at least one pair of opposing liner engagement heads along different sides of the at least one insertion assembly;

at least one engagement head of each of said pair of opposing liner engagement heads being mounted for movement and being movable along engagement head paths which pass along sides of the at least one insertion assembly while the at least one insertion assembly is in said extended position.

25. An apparatus according to claim 16 and wherein:

said at least one liner engagement head includes at least two pair of opposing liner engagement heads, each pair of opposing liner engagement heads having opposing liner engagement heads that are in opposed relationship and engage opposing leaves of a liner;

said at least two pair of opposing liner engagement heads being mounted with at least one pair of opposing liner engagement heads along different sides of the at least one insertion assembly;

at least one engagement head of each of said pair of opposing liner engagement heads being mounted for movement and being movable along engagement head paths which pass along sides of the at least one insertion assembly while the at least one insertion assembly is in said extended position;

said at least one liner engagement head also including at least one vacuum engagement head that applies vacuum when engaging a liner.

26. An apparatus according to claim 16 and wherein said at least one liner engagement head includes at least one pivotal engagement head which is pivotally movable to engage with a liner.

27. An apparatus according to claim 16 and wherein:

said at least one liner engagement head include at least one pivotal engagement head which is pivotally movable to engage with a liner;

said at least one liner engagement head includes at least one linear engagement head which is linearly movable to engage with a liner.

28. An apparatus according to claim 16 and wherein:

said at least one liner engagement head includes at least two pair of opposing liner engagement heads, each pair of opposing liner engagement heads having opposing liner engagement heads that are in opposed relationship and engage opposing leaves of a liner;

said at least two pair of opposing liner engagement heads being mounted with at least one pair of opposing liner engagement heads along different sides of the at least one insertion assembly;

at least one engagement head of each of said pair of opposing liner engagement heads being mounted for movement and being movable along engagement head paths which pass along sides of the at least one insertion assembly while the at least one insertion assembly is in said extended position;

said at least one liner engagement head also including at least one vacuum engagement head that applies vacuum when engaging a liner;

said at least one liner engagement head include at least one pivotal engagement head which is pivotally movable to engage with a liner;

said at least one liner engagement head include at least one linear engagement head which is linearly movable to engage with a liner.

29. An apparatus for inserting a flexible liner into a packaging container, comprising:

a liner supply for supplying a flexible liner to be inserted into a container;

at least one liner engagement head for controllably engaging a flexible liner supplied by the liner supply and positioning the liner for insertion into a container positioned in a container receiving area;

at least one insertion assembly which is movable between retracted and extended positions, said at least one insertion assembly being movable into an extended position to insert a liner into a container positioned in the container receiving area;

at least one cuffing assembly for cuffing a portion of the liner over edges of the container;

wherein said at least on liner engagement head is movable into engagement with a liner held by the liner supply while the at least one insertion assembly is in an extended position inserting another liner into a container positioned in the container receiving area.

30. An apparatus according to claim 29 and wherein said at least one liner engagement head includes at least one movable liner engagement head that is mounted to move and open a liner by separating two opposing leaves of the liner.

31. An apparatus according to claim 29 and wherein the liner supply is a dispenser that supplies liners from a roll.

32. An apparatus according to claim 29 and wherein said at least one liner engagement head includes at least one vacuum engagement head that applies vacuum when engaging a liner.

33. An apparatus according to claim 29 and wherein:

said at least one liner engagement head includes at least one vacuum engagement head that applies vacuum when engaging a liner;

said at least one liner engagement head includes at least one movable liner engagement head that is mounted to move and open a liner by separating two opposing leaves of the liner.

34. An apparatus according to claim 29 and wherein said at least one liner engagement head includes a plurality of vacuum engagement heads that apply vacuum when engaging a liner.

35. An apparatus according to claim 29 and wherein said at least one liner engagement head includes at least two opposing liner engagement heads that are in opposed relationship and engage opposing leaves of a liner.

36. An apparatus according to claim 29 and wherein:

said at least one liner engagement head includes at least two opposing liner engagement heads that are in opposed relationship and engage opposing leaves of a liner;

said at least one liner engagement head also including at least one vacuum engagement head that applies vacuum when engaging a liner.

37. An apparatus according to claim 29 and wherein:

said at least one liner engagement head includes at least two pair of opposing liner engagement heads, each pair of opposing liner engagement heads having opposing liner engagement heads that are in opposed relationship and engage opposing leaves of a liner;

said at least two pair of opposing liner engagement heads being mounted with at least one pair of opposing liner engagement heads alone different sides of the at least one insertion assembly;

at least one engagement head of each of said pair of opposing liner engagement heads being mounted for movement and being movable along engagement head paths which pass along sides of the at least one insertion assembly while the at least one insertion assembly is in said extended position.

38. An apparatus according to claim 29 and wherein:

said at least one liner engagement head include at least two pair of opposing liner engagement heads, each pair of opposing liner engagement heads having opposing liner engagement heads that are in opposed relationship and engage opposing leaves of a liner;

said at least two pair of opposing liner engagement heads being mounted with at least one pair of opposing liner engagement heads alone different sides of the at least one insertion assembly;

at least one engagement head of each of said pair of opposing liner engagement heads being mounted for movement and being movable along engagement head paths which pass along sides of the at least one insertion assembly while the at least one insertion assembly is in said e tended position;

said at least one liner engagement head also including at least one vacuum engagement head that applies vacuum when engaging a liner.

39. An apparatus according to claim 29 and wherein said at least one liner engagement head includes at least one pivotal engagement head which is pivotally movable to engage with a liner.

40. An apparatus according to claim 29 and wherein:

said at least one liner engagement head includes at least one pivotal engagement head which is pivotally movable to engage with a liner;

said at least one liner engagement head includes at least one linear engagement head which is linearly movable to engage with a liner.

41. An apparatus according to claim 29 and wherein:

said at least one liner engagement head includes at least two pair of opposing liner engagement heads, each pair of opposing liner engagement heads having opposing liner engagement heads that are in posed relationship and engage opposing leaves of a liner;

said at least two pair of opposing liner engagement heads being mounted with at least one pair of opposing liner engagement heads along different sides of the at least one insertion assembly;

at least one engagement head of each of said pair of opposing liner engagement heads being mounted for movement and being movable along engagement head paths which pass along sides of the at least one insertion assembly while the at least one insertion assembly is in said extended position;

said at least one liner engagement head also including at least one vacuum engagement head that applies vacuum when engaging a liner;

said at least one liner engagement head includes at least one pivotal engagement head which is pivotally movable to engage with a liner;

said at least one liner engagement head include at least one linear engagement head which is linearly movable to engage with a liner.

42. A method for inserting flexible liners into packaging containers, comprising:

supplying a container to container receiving area associated with a liner insertion apparatus;

dispensing a first liner to a dispensed position of the liner insertion apparatus;

engaging the first liner using at least one movable engagement head;

positioning the first line using said at least one movable engagement head to prepare the first liner for insertion;

inserting the first liner into the container by extending at least one insertion assembly of the liner insertion apparatus against the first liner and into the container positioned in the container receiving area;

dispensing a second liner to a dispensed position of the liner insertion apparatus;

moving said at least one movable engagement head into engagement with the second liner while the at least one insertion assembly is in an extended position associated with said inserting step.

43. A method according to claim 42 and wherein said step of engaging the first liner includes applying vacuum to said first liner.

44. A method according to claim 42:

and wherein said step of engaging the first liner includes applying vacuum to said first liner;

and further comprising engaging the second liner with said at least one movable engagement head, and wherein said step of engaging the second liner includes applying vacuum to said second liner.

45. A method according to claim 42 and further comprising:

retracting said at least one insertion assembly;

removing said container with first liner inserted therein from the container receiving area;

supplying a second container to the container receiving area;

positioning the second liner using said at least one movable engagement head to prepare the second liner for insertion;

inserting the second line into the second container by extending said at least one insertion assembly against the second liner and into the second container positioned in the container receiving area.

46. A method according to claim 42 and wherein said step of engaging the first liner includes engaging the first liner with at least two movable engagement heads which are moved along opposing sides of the at least one insertion assembly.

47. A method according to claim 42 and wherein said step of engaging the first liner includes engaging the first liner with at least two opposing engagement heads that engage opposing leaves of the liner.

48. A method according to claim 42:

and wherein said step of engaging the first liner includes engaging the first liner with at least two opposing engagement heads that engage opposing leaves of the liner;

and further comprising opening the first liner by separating opposing leaves of the liner by moving at least one of said opposing engagement heads.

49. A method according to claim 42 and wherein:

said step of engaging the first liner includes engaging the first liner with at least two movable engagement heads which are moved along opposing sides of the at least one insertion assembly;

said step of engaging the first liner includes engaging the first liner with at least two opposing engagement heads that engage opposing leaves of the liner.

50. A method according to claim 42 and wherein:

said step of engaging the first liner includes engaging the first liner with at least two movable engagement heads which are moved along opposing sides of the at least one insertion assembly;

said step of engaging the first liner includes engaging the first liner with at least two opposing engagement heads that engage opposing leaves of the liner;

and further comprising opening the first liner by separating opposing leaves of the liner by moving at least one of said opposing engagement heads.

51. A method according to claim 42 and wherein said step of engaging the first liner includes engaging the first liner with at least two opposing engagement heads that engage opposing leaves of the liner;

and further comprising:

opening the first liner by separating opposing leaves of the liner by moving at least one of said opposing engagement heads;

engaging the first liner by rotating at least one cuffing assembly which engages the first liner and assists in keeping the first liner in an open condition;

cuffing the first liner about portions of the container by moving said at least one cuffing assembly relative to the container and against the first liner as the first liner is in juxtaposition with the container.

52. A method for inserting a flexible liners into packaging containers, comprising:

supplying a first container to a container receiving area associated with a liner insertion apparatus;

dispensing a first liner to dispensed position of the liner insertion apparatus;

engaging the first liner using at least one movable engagement head;

opening the first liner using said at least one movable engagement head to open and position the first liner for insertion;

inserting the first liner into the first container by extending at least one insertion assembly into the first liner and into the first container positioned in the container receiving area;

dispensing a second line to a dispensed position of the liner insertion apparatus;

moving said at least on movable engagement head into engagement with the second liner while the insertion assembly is still in an extended position relative to said first liner;

engaging the second line using the at least one movable engagement head;

retracting said at least one insertion assembly;

removing said first container with first liner inserted therein from the container receiving area;

supplying a second container in the container receiving area;

opening the second liner using said at least one movable engagement head to open and position the second liner for insertion;

inserting the second lair into the container by extending said at least one insertion assembly into the second liner and into the second container positioned in the container receiving area.

53. A method according to claim 52 and wherein said steps of engaging the first liner and engaging the second liner include applying vacuum to said first liner and to said second liner, respectively.

54. A method according to claim 52 and wherein said steps of engaging the first liner and engaging the second liner include applying vacuum to said first liner and to said second liner so as to apply vacuum to opposing leaves of the liners, respectively.

55. A method according to claim 52 and wherein said at least one movable engagement head includes at least two movable engagement heads which move along opposing sides of the at least one insertion assembly.

56. A method according to claim 52 and wherein:

said steps of engaging the first and second liners include engaging the first and second liners with at least two movable engagement heads which are moved along opposing sides of the at least on insertion assembly;

said steps of engaging the first and second liners include engaging the first and second liners with at least two opposing engagement heads that engage opposing leaves of the liner.

* * * * *

UNITED STATES PATENT AND TRADEMARK OFFICE

CERTIFICATE OF CORRECTION

PATENT NO. : 6,767,316 B2
DATED : July 27, 2004
INVENTOR(S) : McQuary et al.

It is certified that error appears in the above-identified patent and that said Letters Patent is hereby corrected as shown below:

Drawings,
Sheet 2 of 15, please see attached correct drawing sheet.

Column 18,
Line 60, please delete "plural" after "a" and insert -- plurality --.
Line 64, please delete "th" before "flexible" and insert -- the --.

Column 19,
Line 2, please delete "ba" after “the" and insert -- bag --.
Line 39, please delete "ba" after "flexible" and insert -- bag --.
Line 45, please delete "th" after "into" and insert -- the --.
Line 59, please delete "dispense" before "and" and insert -- dispenser --.
Line 60, please delete "a here" after "substantially" and insert -- adhere --.

Column 20,
Lines 20 and 39, please delete “on" after "least" and insert -- one --.

Column 21,
Line 8, please delete "line" after "one" and insert -- liner --.
Lines 12 and 52, please delete "include" after "head" and insert -- includes --.

Column 22,
Line 13, please delete "include" after "head" and insert -- includes --.
Line 32, please delete "on" after "least" and insert -- one --.

Column 23,
Line 36, please delete "e tended" after "said" and insert -- extended --.

Column 24,
Line 18, please delete "line" after "first" and insert -- liner --.
Line 50, please delete "line" after "second" and insert -- liner --.

Column 25,
Line 44, please insert -- a -- after "to".

UNITED STATES PATENT AND TRADEMARK OFFICE

CERTIFICATE OF CORRECTION

PATENT NO. : 6,767,316 B2
DATED : July 27, 2004
INVENTOR(S) : McQuary et al.

It is certified that error appears in the above-identified patent and that said Letters Patent is hereby corrected as shown below:

Column 26,
Line 5, please delete "line" after "second" and insert -- liner --.
Line 7, please delete "on" after "least" and insert -- one --.
Line 22, please delete "lair" after "second" and insert -- liner --.
Line 44, please delete "on" after "least" and insert -- one --.

Signed and Sealed this

Seventeenth Day of May, 2005

JON W. DUDAS
*Director of the United States Patent and Trademark Office*